US009075386B2

(12) United States Patent
Uchida et al.

(10) Patent No.: US 9,075,386 B2
(45) Date of Patent: Jul. 7, 2015

(54) IMAGE FORMING APPARATUS WITH A CURL CORRECTING UNIT

(71) Applicant: CANON KABUSHIKI KAISHA, Tokyo (JP)

(72) Inventors: Wataru Uchida, Yokohama (JP); Ryo Iwasawa, Kawasaki (JP); Tomooku Koyama, Suntou-gun (JP); Taro Ishifune, Mishima (JP); Mitsuhiro Ohta, Mishima (JP); Ken Murooka, Mishima (JP); Masayoshi Fukatsu, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/065,658

(22) Filed: Oct. 29, 2013

(65) Prior Publication Data

US 2014/0126945 A1 May 8, 2014

(30) Foreign Application Priority Data

Nov. 5, 2012 (JP) ..... 2012-243667

(51) Int. Cl.
*G03G 15/00* (2006.01)
*G03G 21/16* (2006.01)

(52) U.S. Cl.
CPC ..... *G03G 21/1685* (2013.01); *G03G 15/6576* (2013.01); *G03G 2215/00662* (2013.01); *G03G 21/1633* (2013.01)

(58) Field of Classification Search
CPC ..... G03G 15/6576; G03G 15/235; G03G 15/2035; G03G 15/2071; G03G 21/1685; G03G 21/1633; G03G 2215/00662; G03G 2221/1675
See application file for complete search history.

(56) References Cited

U.S. PATENT DOCUMENTS

| | | | | |
|---|---|---|---|---|
| 5,290,021 | A | 3/1994 | Murooka et al. | |
| 6,318,718 | B1 | 11/2001 | Ogata et al. | |
| 6,325,371 | B1 | 12/2001 | Araki et al. | |
| 6,382,614 | B1 | 5/2002 | Fukatsu et al. | |
| 6,382,616 | B1 | 5/2002 | Waragai et al. | |
| 6,561,503 | B1 | 5/2003 | Ogata et al. | |
| 6,733,007 | B2 | 5/2004 | Sekiyama et al. | |
| 6,912,044 | B2 | 6/2005 | Sekiyama et al. | |
| 6,973,285 | B2 | 12/2005 | Sekiyama et al. | |
| 6,988,730 | B2 | 1/2006 | Fukatsu et al. | |
| 6,997,456 | B2 | 2/2006 | Fukatsu et al. | |
| 7,753,368 | B2 | 7/2010 | Sekiyama et al. | |
| 7,874,558 | B2 | 1/2011 | Ogata et al. | |
| 8,038,147 | B2 | 10/2011 | Ogata et al. | |
| 8,061,712 | B2 | 11/2011 | Tsuji et al. | |
| 8,113,507 | B2 * | 2/2012 | Ishida | 271/188 |

(Continued)

*Primary Examiner* — Blake A Tankersley
(74) *Attorney, Agent, or Firm* — Fitzpatrick, Cella, Harper & Scinto

(57) ABSTRACT

A representative configuration of an image forming apparatus according to the invention includes: an image forming portion; a transfer portion; a fixing portion; a curl correcting unit which is provided on a downstream of the fixing portion in a sheet conveyance direction and includes a first roller and a second roller; a holding portion which movably holds the second roller; a biasing member which applies a force to the holding portion; a door which rotatably holds the first roller, is supported to be opened and closed, and separates the first roller from the second roller by being opened; and a retracting portion which allows the holding portion to be retracted to a position where the second roller deviates from a movement path of the door against a biasing force of the biasing member according to a closing operation of the door.

12 Claims, 21 Drawing Sheets

(56) References Cited

U.S. PATENT DOCUMENTS

| | | | | |
|---|---|---|---|---|
| 8,382,109 | B2 | 2/2013 | Tsuji et al. | |
| 8,444,141 | B2 | 5/2013 | Sekiyama et al. | |
| 2009/0257802 | A1* | 10/2009 | Eda et al. | 399/406 |
| 2011/0229178 | A1 | 9/2011 | Ogawa et al. | |
| 2013/0049283 | A1 | 2/2013 | Tsuji et al. | |
| 2013/0161901 | A1 | 6/2013 | Uchida et al. | |

* cited by examiner

IMAGE FORMING APPARATUS WITH A CURL CORRECTING UNIT

BACKGROUND OF THE INVENTION

1. Field of the Invention

The present invention relates to an image forming apparatus, and more particularly, to a configuration of correcting a curl of a sheet.

2. Description of the Related Art

Hitherto, in an image forming apparatus such as a copying machine or a printer, a toner image formed by an image forming portion is transferred onto a sheet fed from a feeding portion, and thereafter, the sheet is guided to a fixing device to fix an unfixed toner image on the sheet to the sheet. As such a fixing device, there is a heat pressure fixing-type fixing device which fixes a toner image to a sheet by pressurizing and heating the sheet that passes through the fixing device.

Here, when the sheet is pressurized and heated to fix the toner image to the sheet, the sheet may be curled due to the toner on the sheet or moisture contained in the sheet. In the case where the sheet is curled as such, a jam (sheet clogging) occurs in a conveying portion. Furthermore, there is a concern that loading characteristics of the sheet on a discharge tray may be degraded. Therefore, in the fixing device according to the related art, a curl correcting portion which corrects a curl of a sheet by applying a pressure to the curled sheet in the reverse direction to the direction of the curl of the sheet is provided. In addition, as the curl correcting portion, there is a curl correcting portion which corrects a curl of a sheet using two rollers having different hardnesses (refer to U.S. Patent Application Publication No. 2011/0229178 A1).

However, in the image forming apparatus according to the related art provided with the curl correcting portion, there may be cases where a jam of a sheet occurs in the fixing device. Therefore, on the downstream of the fixing device in a sheet conveyance direction, a door for a jam recovery is provided to support one of the two rollers of the curl correcting portion and remove the jammed sheet. In addition, the door is provided with a guide portion which guides the sheet to a nip portion of the two rollers of the curl correcting portion in a state where the door is closed.

However, in the case where the guide portion is provided in the door as such, when the door is opened and closed, there is a concern that the guide portion may collide with the other roller of the two rollers of the curl correcting portion and thus the roller and the guide portion may be damaged.

SUMMARY OF THE INVENTION

The invention is accomplished in view of the circumstances described above. It is desirable to provide an image forming apparatus capable of opening and closing a door without damaging a roller or a guide portion.

In order to solve the problems, a representative configuration of the image forming apparatus according to the invention includes: an image forming portion which forms a toner image; a transfer portion which transfers the toner image onto a sheet; a fixing portion which includes a pressure roller and a heating member that forms a fixing nip to fix the toner image onto the sheet by coming in press contact with the pressure roller; a curl correcting unit which is provided on a downstream side of the fixing portion in a sheet conveyance direction and includes a first roller and a second roller that forms a correction nip to correct a curl of the sheet by coming in press contact with the first roller; a holding portion which movably holds the second roller; a biasing member which applies a force to the holding portion in such a direction that the second roller comes in press contact with the first roller; a door which rotatably holds the first roller, is supported to be opened and closed, and separates the first roller from the second roller by being opened; and a retracting portion which allows the holding portion to be retracted to a position where the second roller deviates from a movement path of the door against a biasing force of the biasing member according to a closing operation of the door.

Further features of the present invention will become apparent from the following description of exemplary embodiments with reference to the attached drawings.

DESCRIPTION OF THE EMBODIMENTS

Figure 1:
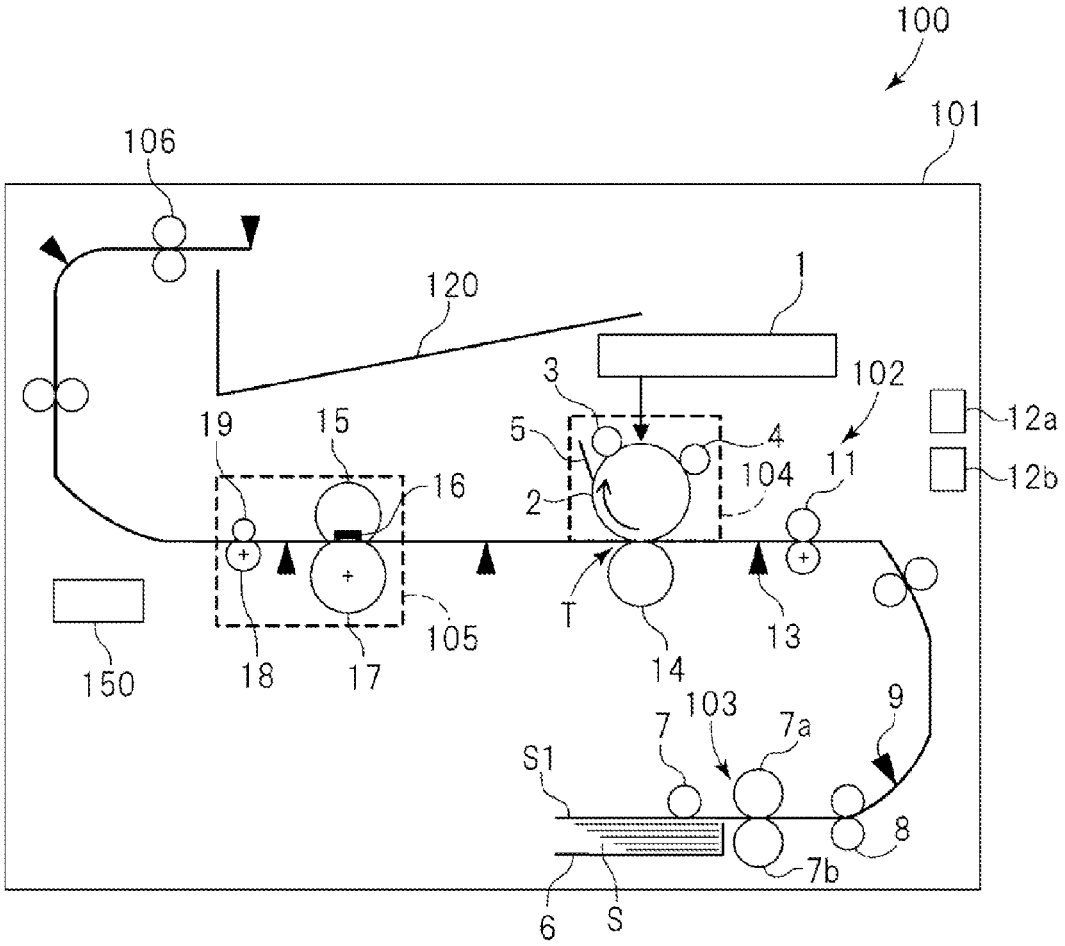
FIG. 1 is a diagram illustrating the entire configuration of a laser beam printer which is an example of an image forming apparatus according to a first embodiment of the invention.

Hereinafter, embodiments of the invention will be described in detail with reference to the drawings. FIG. 1 is a diagram illustrating the entire configuration of a laser beam printer (LBP) which is an example of an image forming apparatus according to a first embodiment of the invention.

In FIG. 1, a laser beam printer 100 and a laser beam printer body (hereinafter, referred to as a printer body) 101 are provided. In addition, the printer body 101 includes an image forming portion 102 and includes, at the lower portion of the printer body 101, a sheet feeding device 103 which feeds a sheet S such as a recording sheet loaded and stored in a sheet feeding cassette 6 to the image forming portion 102.

Here, the image forming portion 102 includes a process cartridge 104 including a photosensitive drum 2, a charging roller 3, a developing roller 4, a cleaning blade 5, and the like. In addition, a laser optical system 1 which is an exposure unit that exposes the surface of the photosensitive drum 2 to form an electrostatic latent image on the photosensitive drum 2 is provided. Further, the printer body 101 includes a transfer roller 14 that abuts on the photosensitive drum 2 and forms a transfer portion T together with the photosensitive drum 2, a fixing device 105 that fixes a toner image transferred from the transfer portion T onto the sheet S, and the like.

The sheet feeding device 103 includes a pickup roller (feeding roller) 7 which feeds the sheet S at the highest level stored in the sheet feeding cassette 6 which is a sheet storage portion. In addition, the sheet feeding device 103 includes a feed roller 7*a* that is rotated in a sheet conveyance direction and a retard roller 7*b* which comes in press contact with the feed roller 7*a* and forms a separation nip portion to separate the sheets between the retard roller 7*b* and the feed roller 7*a* one from another.

In FIG. 1, a control portion 150 controls an image forming operation of the printer body 101 and a sheet feeding operation of the sheet feeding device 103. A conveyance sensor 9 detects the passage of the sheet, a temperature sensor 12*a* detects the ambient temperature (environmental temperature) of the printer body, and a humidity sensor 12*b* detects the ambient humidity (environmental humidity) of the printer body. In addition, information from the conveyance sensor 9, the temperature sensor 12*a*, and the humidity sensor 12*b* is input to the control portion 150.

Next, the image forming operation performed in the laser beam printer 100 configured as such will be described. When the image forming operation is started, first, the pickup roller 7 of the sheet feeding device 103 is rotated to feed a sheet S1 at the highest level on the sheet feeding cassette 6. In addition, the sheet S1 fed by the pickup roller 7 as such is separated and conveyed by the pair of separation rollers 7*a* and 7*b* and is then conveyed to a pair of registration rollers 11 at a standstill by a conveying roller 8 so as to be subjected to tip end positioning (skew feeding correction).

After the tip end positioning is performed, the pair of registration rollers 11 is rotated, and the sheet S1 is conveyed by the pair of registration rollers 11. In addition, when the sheet S1 is conveyed to a top sensor 13, the control portion 150 allows the laser optical system 1 to emit a laser beam onto the photosensitive drum 2 charged by the charging roller 3 based on image information input from an external personal computer (PC). Accordingly, an electrostatic latent image is formed on the photosensitive drum. Next, toner that is appropriately charged is supplied to the photosensitive drum 2 and adheres to the electrostatic latent image as the developing roller 4 is rotated such that the electrostatic latent image is developed and visualized as a toner image.

Next, the sheet S1 conveyed by the pair of registration rollers 11 reaches the transfer portion T, and the image on the photosensitive drum 2 is transferred onto the sheet S1 by the transfer roller 14. In addition, the photosensitive drum 2 on which the toner image is transferred is cleaned by the cleaning blade 5 so that residual toner is removed. Thereafter, the sheet S1 on which the toner image is transferred is conveyed to the fixing device 105 and is heated and pressurized when passing through the fixing device 105 such that an unfixed toner image on the sheet is fixed to the sheet surface. The sheet S1 on which the toner image is fixed as such is discharged onto a discharge tray 120 by a discharge roller 106.

Figure 2:
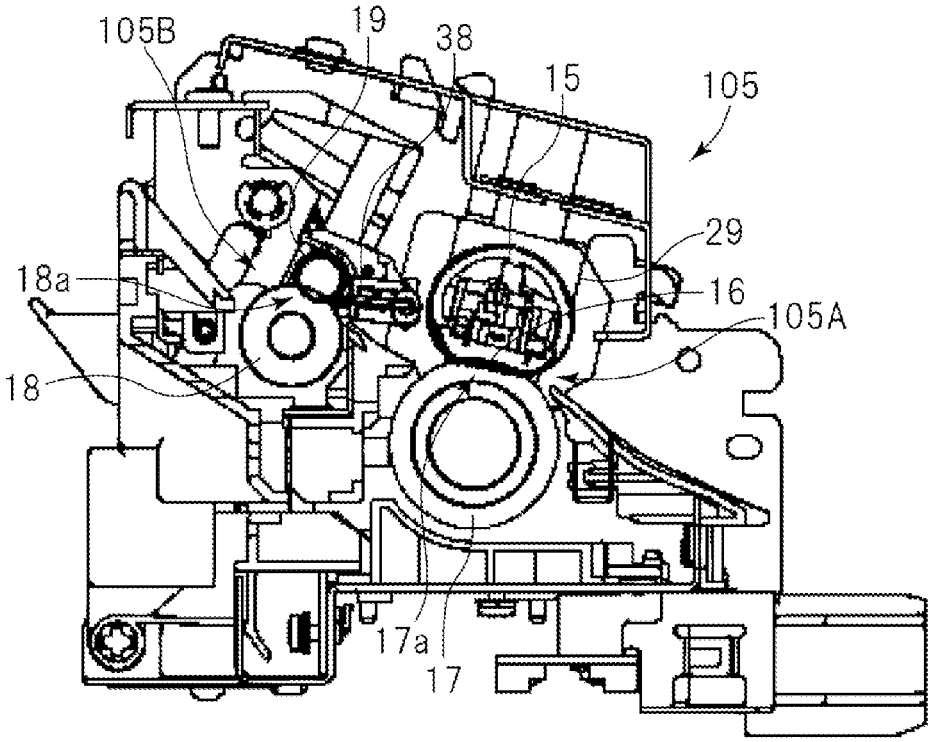
FIG. 2 is a diagram illustrating the configuration of a fixing device provided in the laser beam printer.

Here, as illustrated in FIG. 2, the fixing device 105 includes a fixing film 15 which is a heating member included in a fixing portion 105A, a fixing heater 16, and a pressure roller 17. In addition, the fixing device 105 includes a decurl roller 18 included in a curl correcting unit 105B, and a decurl counter roller 19 which detachably comes in press contact with the decurl roller 18 so as to form a decurl nip 18*a*. In addition, the sheet on which the toner image is transferred is heated and pressurized when passing through a fixing nip 17*a* formed by the fixing film 15, the fixing heater 16, and the pressure roller 17 such that the toner image is fixed. In addition, the sheet on which the toner image is fixed is thereafter conveyed to the decurl nip 18*a* and when the sheet passes through the decurl nip 18*a*, the curl of the sheet is corrected.

In this embodiment, the material of the decurl roller 18 is a foam silicone rubber having an ASKER C type hardness of approximately 30 degrees, and the material of the decurl counter roller 19 is iron. In addition, as the decurl roller 18 which is an elastic roller having such a low hardness is pressurized by the decurl counter roller 19 which is a non-elastic roller having a high hardness, the decurl nip 18*a* is formed along the outside diameter of the decurl counter roller 19. Accordingly, while the sheet is conveyed through the decurl nip 18*a*, the curl formed in the sheet by the fixing nip 17*a* is corrected.

Figure 3A:
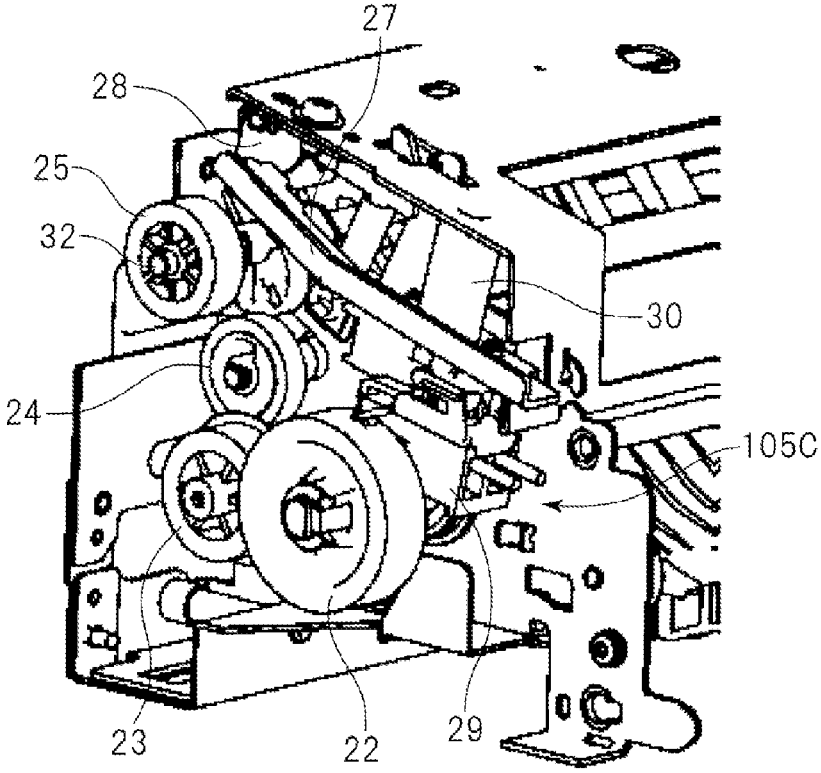
FIGS. 3A and 3B are side perspective views of the fixing device.
Figure 3B:
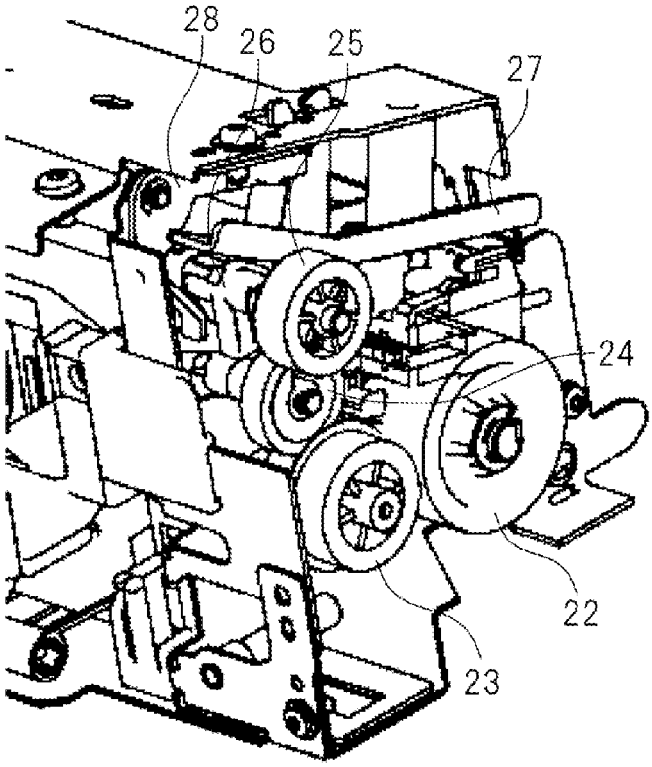

FIGS. 3A and 3B are side perspective views of the fixing device 105. In addition, FIG. 3A is a side perspective view in which an upstream side in the sheet conveyance direction is the viewpoint, and FIG. 3B is a side perspective view in which a downstream side in the sheet conveyance direction is the viewpoint.

In FIGS. 3A and 3B, a fixing drive gear 22 is rotated to drive the pressure roller 17, and a decurl gear 24 is rotated to drive the decurl roller 18. In addition, when the fixing drive gear 22 is rotated to drive, the driving of the fixing drive gear 22 is transmitted to the decurl gear 24 via an idler gear 23 such that the decurl roller 18 is rotated. In addition, the fixing film 15 is driven to be rotated along the pressure roller 17 which is rotated to drive, and the decurl counter roller 19 is driven to be rotated along the decurl roller 18. In this embodiment, the decurl roller 18 is the driving side and the decurl counter roller 19 is the driven side to enable the conveyance speeds of the sheet at the fixing nip and at the decurl nip to be easily matched.

When a print job is continuously performed, the temperature of the pressure roller 17 of which the material is a silicone rubber having an ASKER C type hardness of approximately 50 degrees is increased and thus the outside diameter thereof is increased due to thermal expansion. Since the decurl roller 18 is disposed in the vicinity of the fixing nip, the decurl roller 18 comes in contact with the sheet which is at a high temperature immediately after fixing and thus the outside diameter thereof is increased due to thermal expansion in the same manner. Accordingly, the conveyance speeds can be easily matched when the decurl roller 18 having a high thermal expansion like the pressure roller 17 is driven compared to when the decurl counter roller 19 made of iron having a low thermal expansion is driven. In addition, by allowing the conveyance speeds of the sheet at the fixing nip and the decurl nip to be matched, conveyance problems such as wrinkling and folding of the sheet are easily prevented.

Figure 4A:
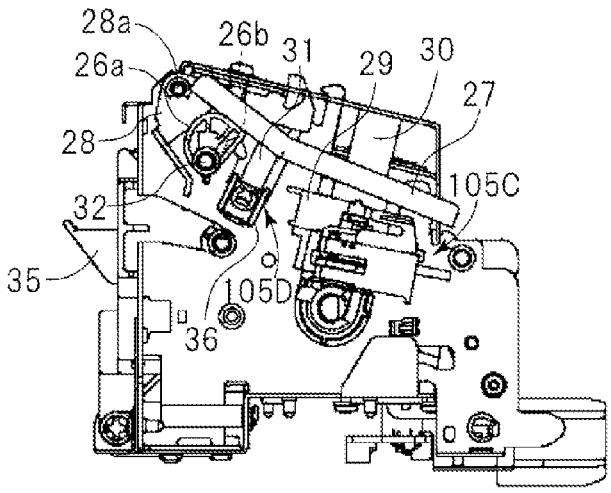
FIGS. 4A to 4C are diagrams illustrating switching operations of a fixing nip pressure and a decurl nip pressure, which are performed by a fixing nip pressure changing mechanism and a decurl nip pressure changing mechanism provided in the fixing device.
Figure 4B:
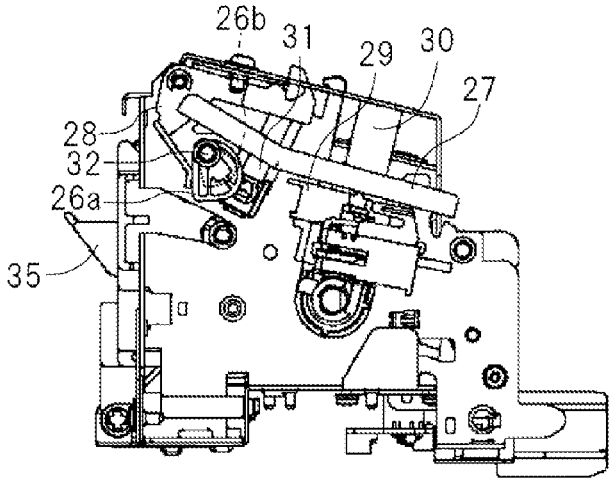
Figure 4C:
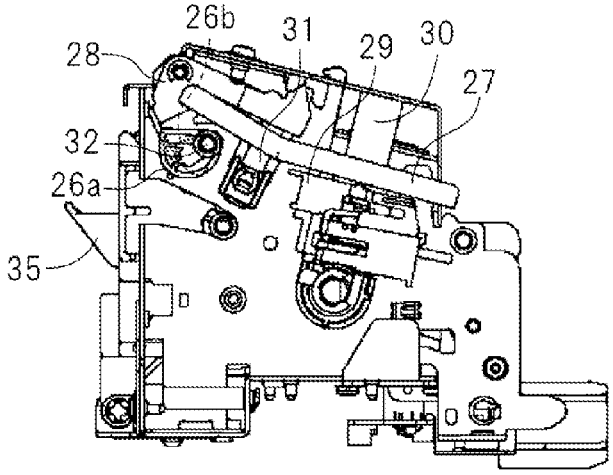
Figure 5:
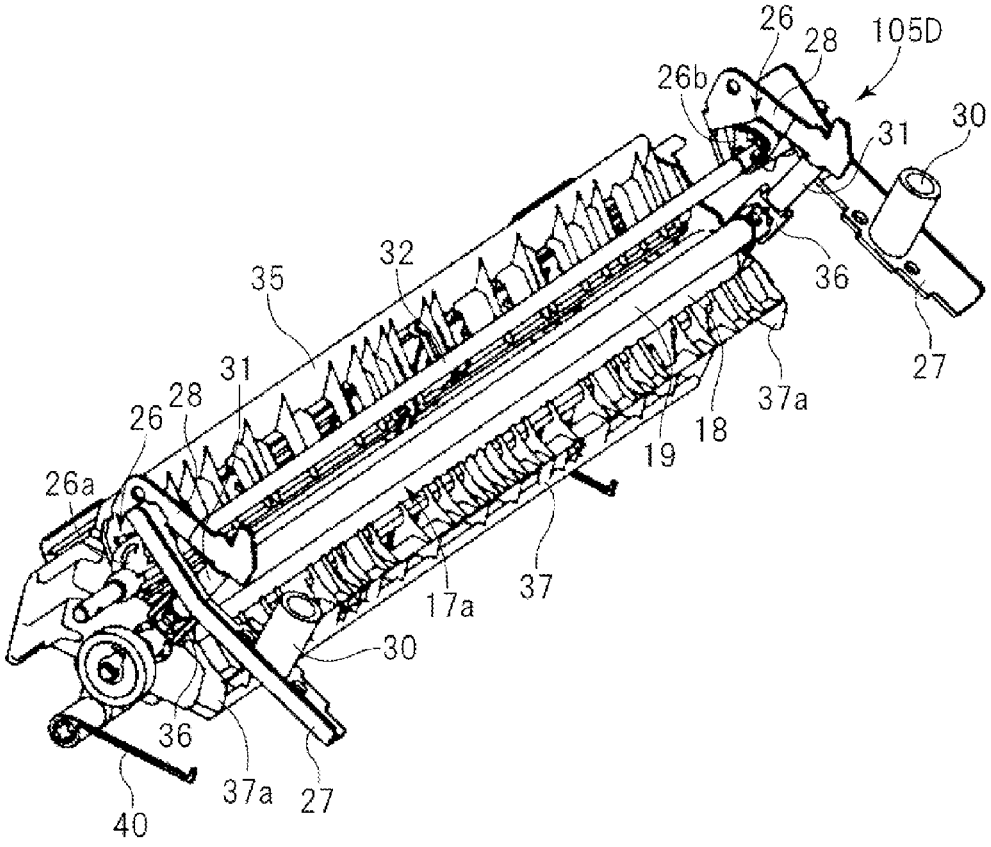
FIG. 5 is a diagram illustrating the configuration of the decurl nip pressure changing mechanism.

In FIGS. 3A and 3B, a pressure control gear 25 is rotated by a motor M illustrated in FIG. 7, which will be described later, and a pressure control cam 26 is a cam member which is fixed to a pressure control gear shaft 32 of the pressure control gear 25. In addition, as illustrated in FIG. 5, which will be described later, the pressure control cam 26 includes cam shapes 26*a* and 26*b* which have different shapes in the width direction (axial direction) orthogonal to the sheet conveyance direction. In FIGS. 4A to 4C, a fixing pressure lever 27 is turned in the vertical direction about a turning shaft (not illustrated) by the outside cam shape 26*a* of the pressure control cam 26. A decurl pressure lever 28 is a correction pressure lever which is turned in the vertical direction about a turning shaft 28*a* by the inside cam shape 26*b* of the pressure control cam 26.

In FIGS. 3A and 3B, a fixing flange 29 rotatably supports the fixing film 15, and a fixing pressure spring 30 applies a force to the fixing pressure lever 27 in the downward direction. In addition, the fixing pressure spring 30 applies a force to the fixing flange 29 from the upper side. Therefore, by applying a force to the fixing flange 29 from the upper side, the fixing film 15 comes in press contact with the pressure roller 17. In addition, in FIGS. 4A to 4C, which will be described later, a decurl counter roller bearing 36 rotatably supports the decurl counter roller 19, and a decurl pressure spring 31 is provided between the decurl counter roller bearing 36 and the decurl pressure lever 28. The decurl pressure spring 31 which is a biasing member applies a force to the decurl counter roller bearing 36 in such a direction that the decurl counter roller 19 comes in press contact with the decurl roller 18.

Here, the pressure control cam 26 switches a pressurizing force applied to the pressure roller 17 by the fixing film 15 via the fixing pressure lever 27 using the outside cam shape 26*a*. In addition, the pressure control cam 26 switches a pressurizing force applied to the decurl roller 18 by the decurl counter roller 19 via the decurl pressure lever 28 using the inside cam shape 26*b*. As such, in this embodiment, a fixing nip pressure changing mechanism 105C which changes the pressurizing force of the fixing nip is configured by the outside cam shape 26*a* of the pressure control cam 26, the fixing pressure lever 27, and the fixing pressure spring 30. In addition, as illustrated in FIG. 5, a decurl nip pressure changing mechanism 105D which changes the pressurizing force of the decurl nip as a correction nip is configured by the inside cam shape 26*b* of the pressure control cam 26, the decurl pressure lever 28, and the decurl pressure spring 31.

FIG. 4A illustrates the states of the fixing nip pressure changing mechanism 105C and the decurl nip pressure changing mechanism 105D during conveyance and during a jam recovery. At this time, the fixing pressure lever 27 is turned upward against the fixing pressure spring 30 by the outside cam shape 26*a* of the pressure control cam 26 and is separated from the fixing flange 29. Therefore, the pressurizing force of the fixing pressure spring 30 is not applied to the fixing film 15, and the fixing nip pressure becomes approximately 0 under the self-weights of only the fixing flange 29 and the fixing film 15. That is, the fixing nip pressure becomes "weak". On the other hand, the inside cam shape 26*b* of the pressure control cam 26 at this time is separated from the decurl pressure lever 28. Accordingly, the decurl pressure spring 31 is in an elongated state, and a decurl nip pressure as a correction nip pressure is in a "weak" state. That is, during conveyance and the jam recovery, a state (first state) where the fixing nip pressure is "weak" and the decurl nip pressure is "weak" is set.

FIG. 4B illustrates the states of the fixing nip pressure changing mechanism 105C and the decurl nip pressure changing mechanism 105D when the pressure control cam 26 is rotated clockwise by 140° from the state of FIG. 4A. In addition, this state is a state selected when printing is performed in a state where temperature or humidity is low and the amount of moisture in the air is low, that is, in a state where the amount of moisture contained in the sheet is low and a curl formed in the sheet at the fixing nip is small. At this time, the outside cam shape 26*a* of the pressure control cam 26 is separated from the fixing pressure lever 27 and the fixing pressure lever 27 is turned downward by the fixing pressure spring 30. As a result, the pressurizing force of the fixing pressure spring 30 is applied to the fixing film 15 via the fixing pressure lever 27 and the fixing flange 29 and thus the fixing nip pressure is in a "strong" state. In addition, since the inside cam shape 26*b* of the pressure control cam 26 is separated from the decurl pressure lever 28, the decurl nip pressure is in a "weak" state. That is, in a state where temperature or humidity is low and the amount of moisture in the air is low, that is, in a state where the curl formed in the sheet at the fixing nip is small, a state (second state) where the fixing nip pressure is "strong" and the decurl nip pressure is "weak" is set.

FIG. 4C illustrates the states of the fixing nip pressure changing mechanism 105C and the decurl nip pressure changing mechanism 105D when the pressure control cam 26 is rotated clockwise by 80° from the state of FIG. 4B. In addition, this state is a state selected when printing is performed in a state where temperature and humidity are high and the amount of moisture in the air is high, that is, in a state where the amount of moisture contained in the sheet is high and the curl formed in the sheet at the fixing nip is large.

At this time, the outside cam shape 26*a* of the pressure control cam 26 is separated from the fixing pressure lever 27 and the pressurizing force of the fixing pressure spring 30 is applied to the fixing film 15 via the fixing pressure lever 27 and the fixing flange 29. Therefore, the fixing nip pressure remains in the "strong" state. In addition, the inside cam shape 26*b* of the pressure control cam 26 comes in contact with the decurl pressure lever 28 to rotate the decurl pressure lever 28 clockwise. Accordingly, the spring length of the decurl pressure spring 31 is shortened, and thus the decurl nip pressure is in a "strong" state. That is, in a state where temperature and humidity are high and the amount of moisture in the air is high, that is, in a state where the curl formed in the sheet at the fixing nip is large, a state (third state) where the fixing nip pressure is "strong" and the decurl nip pressure is "strong" is set.

Figure 6:
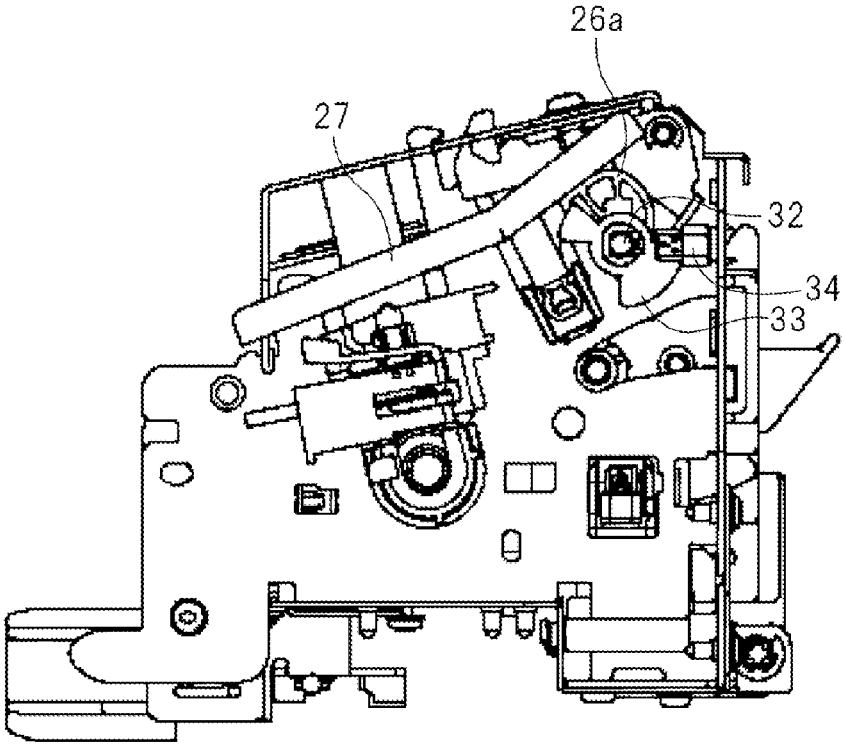
FIG. 6 is a diagram illustrating a configuration for detecting states of the fixing nip pressure and the decurl nip pressure.

In addition, as illustrated in FIG. 6, a sensor flag 33 is fixed to the pressure control gear shaft 32 to which the pressure control gear 25 and the pressure control cam 26 are mounted.

In addition, when the pressure control gear shaft 32 is rotated, a state detection sensor 34 which is a photosensor that detects the states of the fixing nip pressure and the decurl nip pressure is shaded by the sensor flag 33. Accordingly, the control portion 150 can detect the rotational phase of the pressure control cam 26, that is, the states of the fixing nip pressure and the decurl nip pressure.

Figure 7:
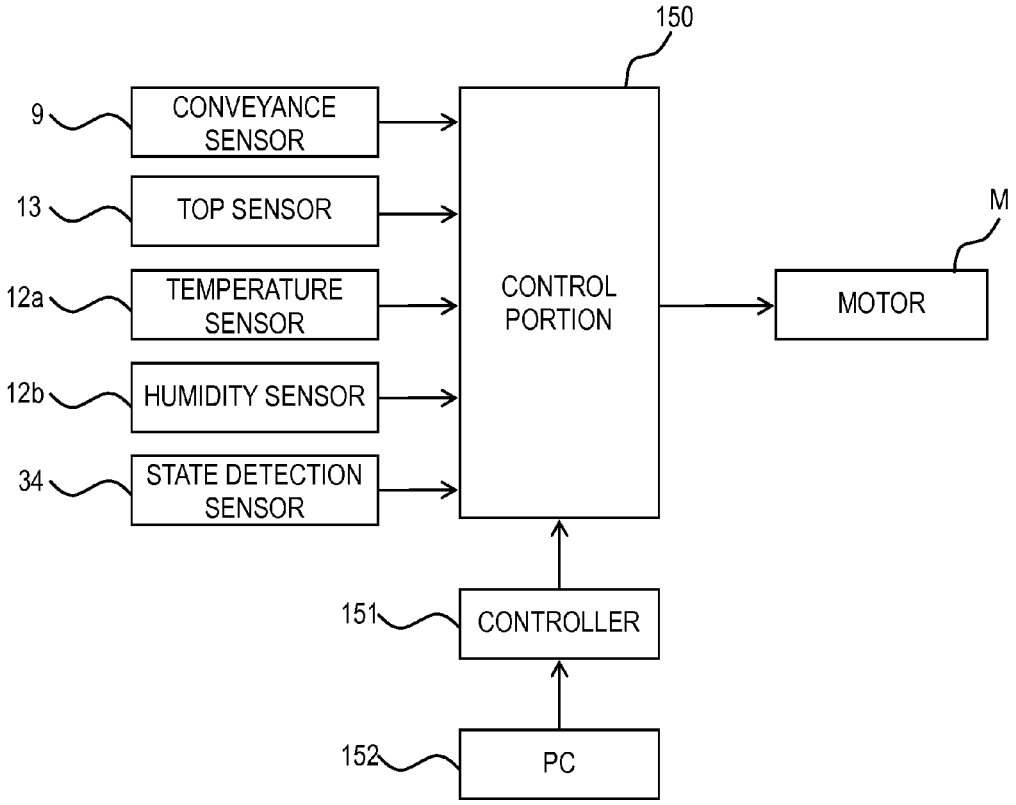
FIG. 7 is a control block diagram of the laser beam printer.

FIG. 7 is a control block diagram of the laser beam printer 100. Information from the conveyance sensor 9, the temperature sensor 12*a*, the humidity sensor 12*b*, and the state detection sensor 34 is input to the control portion 150 which is a control unit. As described later, the control portion 150 obtains the amount of moisture in the air based on the temperature information and the humidity information from the temperature sensor 12*a* and the humidity sensor 12*b* and a table (not illustrated) for obtaining the amount of moisture in the air based on temperature and humidity.

In addition, when the power is "ON" from "OFF", the control portion 150 drives the motor M which rotates the pressure control cam 26 to make at least one revolution of the pressure control cam 26, thereby setting the rotational phase of the pressure control cam 26, that is, the states of the fixing nip pressure and the decurl nip pressure. In addition, a controller 151 inputs a signal from an external PC 152 to the control portion 150.

Here, for example, an amount of moisture in the air of 19.1 g/m$^2$ corresponds to a temperature 28 C.° and a humidity of 70%. In addition, in a high temperature and high humidity environment in which the amount of moisture in the air is high, the amount of moisture contained in the sheet is increased. In this case, a heat amount applied to the sheet at the fixing nip is less likely to be uniformly transferred to the front and rear of the sheet, and thus the curl is enlarged. In contrast, in a room temperature and normal humidity environment or a low temperature and low humidity environment, the amount of moisture contained in the sheet is reduced. In this case, a heat amount applied to the sheet at the fixing nip is more likely to be uniformly transferred to the front and rear of the sheet, and thus the curl is reduced.

In this embodiment, the fixing nip pressure and the decurl nip pressure are controlled to be set to the following three states by the pressure control cam 26, the fixing pressure lever 27, and the decurl pressure lever 28. That is, the fixing nip pressure and the decurl nip pressure are controlled to be set to an A state in which the fixing nip pressure is "weak" and the decurl nip pressure is "weak", a B state in which the fixing nip pressure is "strong" and the decurl nip pressure is "weak", and a C state in which the fixing nip pressure is "strong" and the decurl nip pressure is "strong". That is, in this embodiment, the fixing nip pressure and the decurl nip pressure can be controlled by a simple and small configuration including the pressure control cam 26, the fixing pressure lever 27, and the decurl pressure lever 28.

Figure 8:
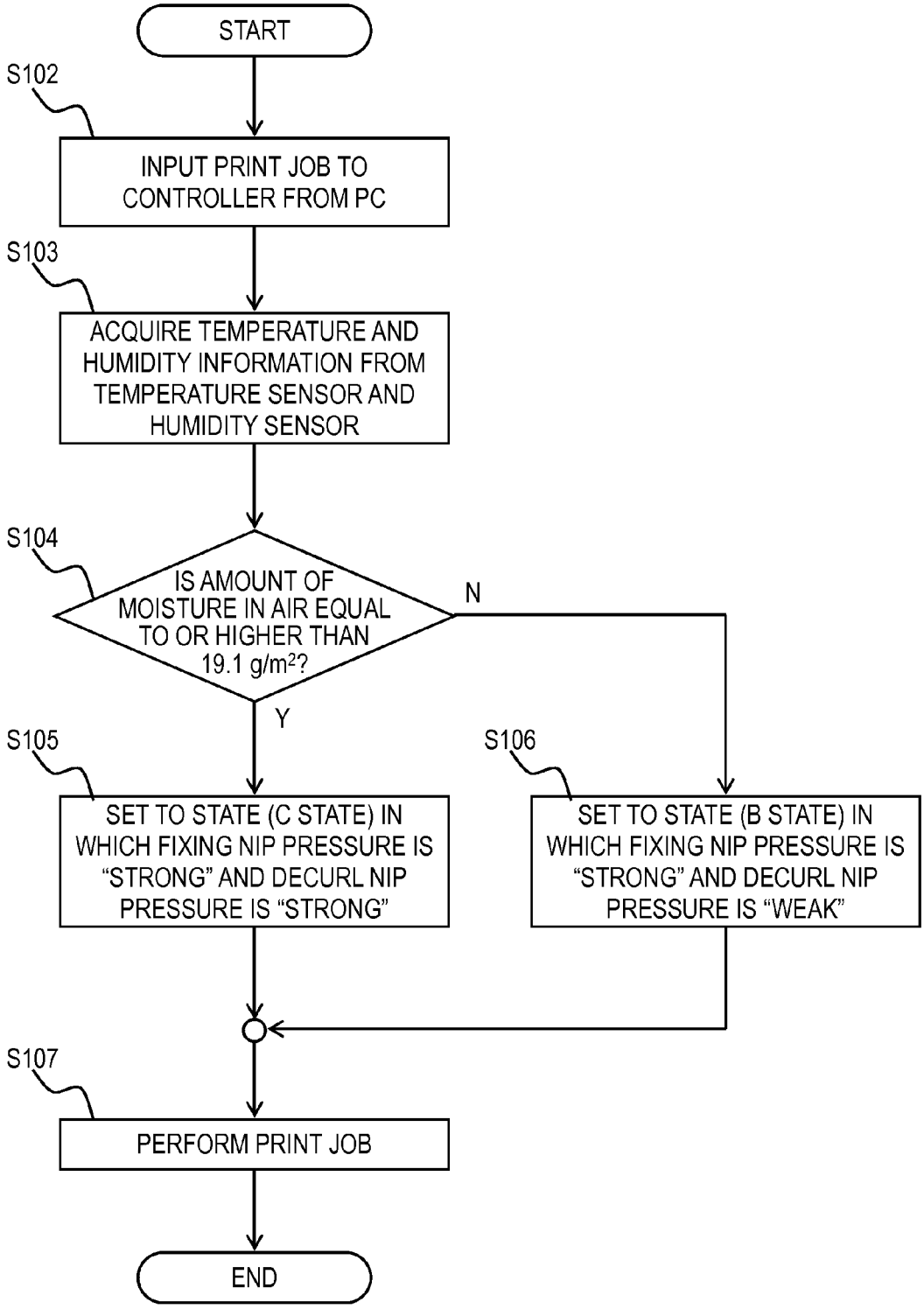
FIG. 8 is a flowchart illustrating a control process of the fixing nip pressure and the decurl nip pressure.

Next, a control process of the fixing nip pressure and the decurl nip pressure when a print job is performed by the control portion 150 will be described using the flowchart illustrated in FIG. 8. When the print job is input to the controller by the external PC (S102), the control portion 150 acquires temperature information and the humidity information from the temperature sensor 12*a* and the humidity sensor 12*b* which are environmental sensors (S103). In addition, the control portion 150 obtains the amount of moisture in the air based on the acquired temperature information and humidity information and the table (not illustrated) and determines whether or not the amount of moisture in the air is equal to or higher than 19.1 g/m$^2$ (S104).

Here, when the amount of moisture in the air is equal to or higher than 19.1 g/m$^2$ (Y in S104), the control portion 150 drives the motor M to rotate the pressure control cam 26. By rotating the pressure control cam 26 as such, the control portion 150 sets the fixing nip pressure changing mechanism 105C and the decurl nip pressure changing mechanism 105D to the state (C state) in which the fixing nip pressure is "strong" and the decurl nip pressure is "strong" (S105). By setting to the C state in which the fixing nip pressure is "strong" and the decurl nip pressure is "strong", even in the high temperature and high humidity environment in which fixing is easily performed but curling is likely to occur, both good fixability and a low degree of curling can be achieved.

In addition, when the amount of moisture in the air is less than 19.1 g/m$^2$ (N in S104), the control portion 150 sets the fixing nip pressure changing mechanism 105C and the decurl nip pressure changing mechanism 105D to the state (B state) in which the fixing nip pressure is "strong" and the decurl nip pressure is "weak" (S106). By setting to the B state in which the fixing nip pressure is "strong" and the decurl nip pressure is "weak", the curl of the sheet with a small curl can be appropriately corrected. Thereafter, the control portion 150 starts the conveyance of the sheet and the image forming operation and performs the print job (S107).

In a case where a jam occurs in a state where the sheet remains in the fixing device, the control portion 150 performs control to set the A state in which the fixing nip pressure is "weak" and the decurl nip pressure is "weak" illustrated in FIG. 4A. For example, in a case where a jam occurs when a print job is performed in the high temperature and high humidity environment, the control portion 150 rotates the pressure control cam 26 clockwise by 140° to set the A state from the C state in which the fixing nip pressure is "strong" and the decurl nip pressure is "strong" illustrated in FIG. 4B.

As such, in this embodiment, the control portion 150 controls the fixing nip pressure changing mechanism 105C and the decurl nip pressure changing mechanism 105D to be set to an appropriate state in which both good fixability and a low degree of curling can be achieved based on the temperature information and the humidity information depending on the temperature and humidity. For example, under the high temperature and high humidity environment in which fixing is easily performed due to an increase in the temperature of the sheet as described above but curling is likely to occur due to a high amount of moisture contained in the sheet, the fixing nip pressure is weakened and the decurl nip pressure is increased.

As such, in this embodiment, the fixing nip pressure and the decurl nip pressure can be changed without being necessarily linked to each other. Therefore, both good fixability and a low degree of curling can be achieved regardless of environment. In addition, since the decurl nip pressure changing mechanism 105D has a simple and small configuration, the decurl roller 18 can be disposed near the downstream side of the fixing nip. Therefore, both a reduction in the size of the apparatus and a good ability to correct a curl can be achieved.

Figure 9A:
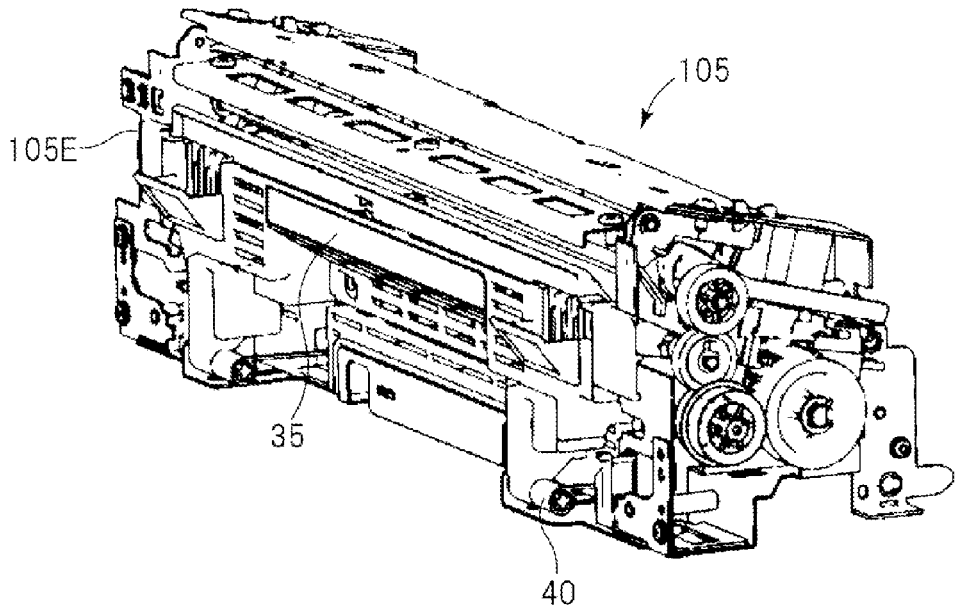
FIGS. 9A and 9B are diagrams illustrating a jam recovery door provided in the fixing device.
Figure 9B:
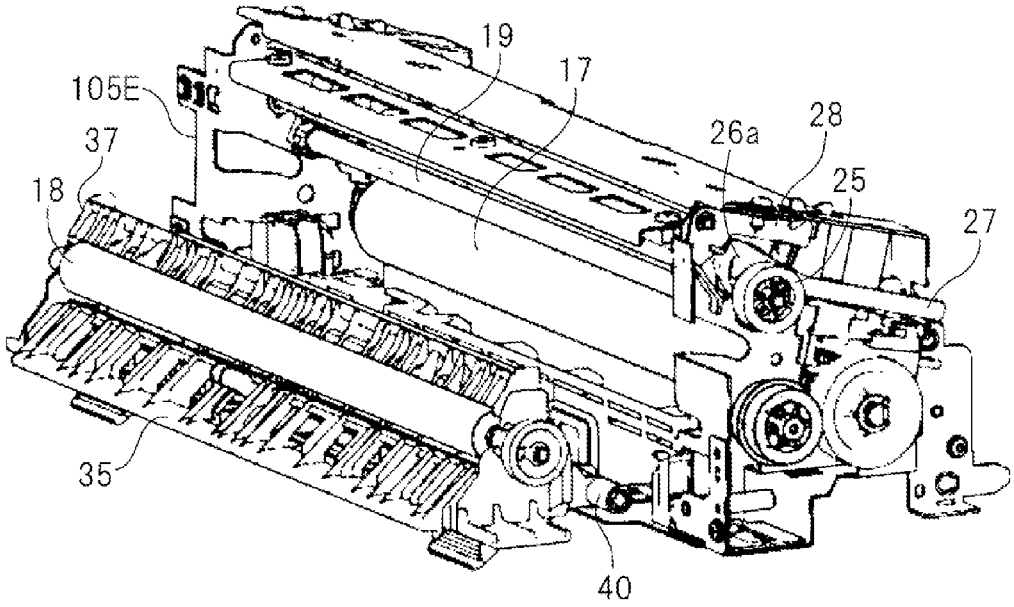

Here, in this embodiment, as illustrated in FIGS. 9A and 9B, in order to remove the sheet that remains in the fixing device 105, a jam recovery door 35, which is a door, is supported by a housing 105E which forms a fixing device body so as to be opened and closed. In addition, the decurl roller 18, which is a first roller, is rotatably supported by the jam recovery door 35. That is, in this embodiment, the jam recovery door 35 is provided to be opened and closed, and the decurl roller 18 is rotatably supported by the jam recovery door 35. Further, the decurl counter roller bearing 36 of the decurl counter roller 19 (see FIG. 5) is also supported by the housing 105E.

FIG. 9A illustrates a state where the jam recovery door 35 is closed, and FIG. 9B illustrates a state where the jam recovery door 35 is opened at an opening angle of 90 degrees. In addition, when the jam recovery door 35 is opened by 90 degrees, the decurl roller 18 is significantly separated from the decurl counter roller 19 which is a second roller, and thus a sufficient space for a hand to enter to perform a jam recovery can be secured between the decurl roller 18 and the decurl counter roller 19.

FIG. 5, described above, illustrates the states of the jam recovery door 35, the fixing nip pressure changing mechanism 105C, and the decurl nip pressure changing mechanism 105D in the case where the jam recovery door 35 is closed as illustrated in FIG. 9A. In FIG. 5, a conveyance guide 37 is provided to be integrated into the jam recovery door 35 and guides the sheet to the fixing nip 17*a*, and cam shapes 37*a* are formed at both side surfaces in the width direction orthogonal to the sheet conveyance direction of the conveyance guide 37. In addition, in FIG. 5, a torsion coil spring 40 is provided as an example of a door biasing member, and the torsion coil spring 40 applies a force to the jam recovery door 35 in such a direction that the jam recovery door 35 is closed.

Figure 10A:
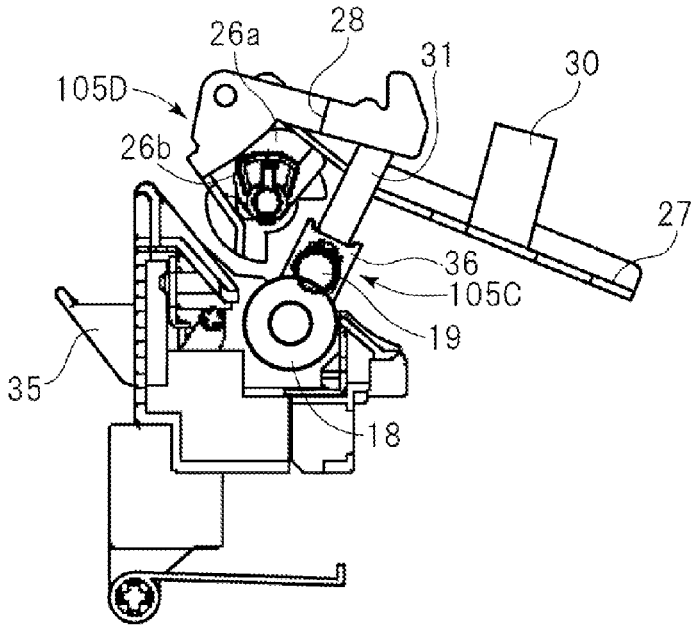
FIGS. 10A and 10B are first diagrams illustrating states of the jam recovery door, the fixing nip pressure changing mechanism, and the decurl nip pressure changing mechanism when the jam recovery door is opened and closed.

FIG. 10A illustrates the states of the jam recovery door 35, the fixing nip pressure changing mechanism 105C, and the decurl nip pressure changing mechanism 105D before the jam recovery door 35 is opened for the jam recovery. At this time, as illustrated in FIG. 4A described above, since the A state in which the fixing nip pressure is "weak" and the decurl nip pressure is "weak" is set, a user can open the jam recovery door 35 with a small operating force.

Figure 10B:
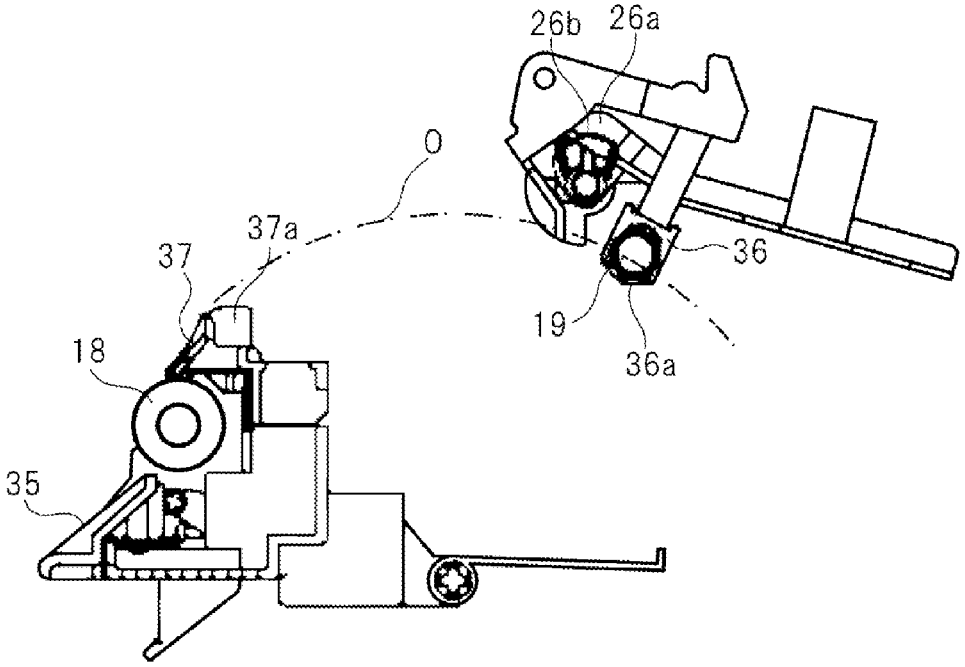

FIG. 10B illustrates the states of the jam recovery door 35, the fixing nip pressure changing mechanism 105C, and the decurl nip pressure changing mechanism 105D when the jam recovery door 35 is opened by 90 degrees as illustrated in FIG. 9B. At this time, the decurl roller 18 and the decurl counter roller 19 are separated from each other and a sufficient space for performing the jam recovery is secured between the decurl roller 18 and the decurl counter roller 19. In addition, as illustrated in FIG. 10B, a cam follower shape 36*a* is formed at the bottom surface of the decurl counter roller bearing 36 which is a holding portion that holds the decurl counter roller 19 to be movable to the housing.

Figure 11A:
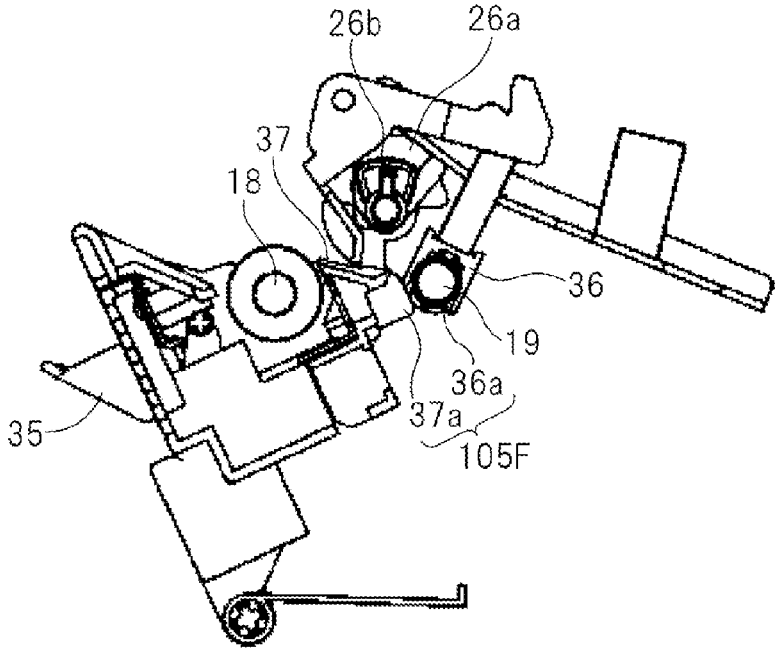
FIGS. 11A and 11B are second diagrams illustrating the states of the jam recovery door, the fixing nip pressure changing mechanism, and the decurl nip pressure changing mechanism when the jam recovery door is opened and closed.

FIG. 11A illustrates the states of the jam recovery door 35, the fixing nip pressure changing mechanism 105C, and the decurl nip pressure changing mechanism 105D in a state where the jam recovery door 35 illustrated in FIGS. 9B and 10B is closed by 65 degrees from the state of being opened by 90 degrees. Here, when the jam recovery door 35 is closed by 65 degrees, the cam shape 37*a* provided in the conveyance guide 37 integrated into the jam recovery door 35 comes in contact with the cam follower shape 36*a* provided in the decurl counter roller bearing 36. In addition, the cam shape 37*a* of the conveyance guide 37 is configured to abut on the cam follower shape 36*a* before the conveyance guide 37 when the jam recovery door 35 is closed, and thereafter move while coming in contact with the cam follower shape 36*a*.

Figure 11B:
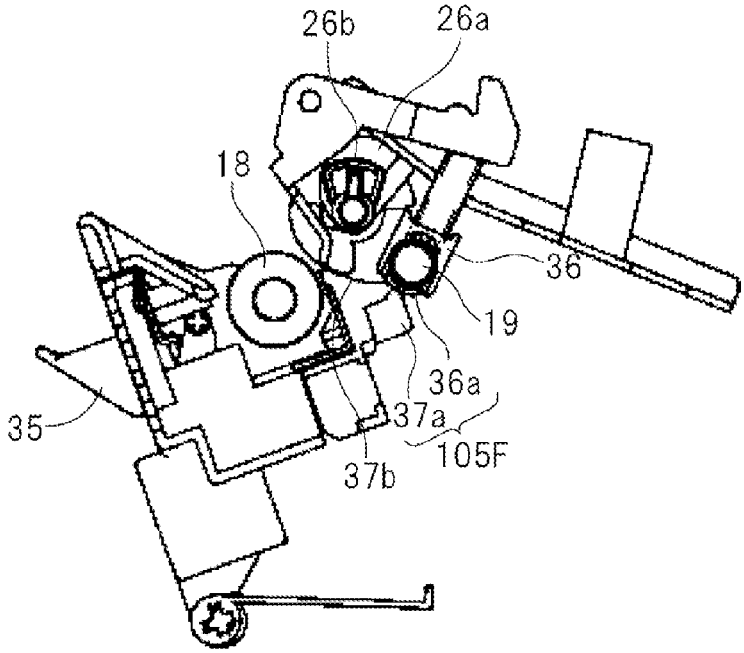

FIG. 11B illustrates the states of the jam recovery door 35, the fixing nip pressure changing mechanism 105C, and the decurl nip pressure changing mechanism 105D in a state where the jam recovery door 35 is closed by 70 degrees from the state of being opened by 90 degrees. At this time, the cam shape 37*a* of the conveyance guide 37 comes in contact with the cam follower shape 36*a* of the decurl counter roller bearing 36. Accordingly, thereafter, when the jam recovery door 35 is further moved in such a direction that the jam recovery door 35 is closed, the decurl counter roller bearing 36 is pressed by the cam shape 37*a* of the conveyance guide 37 and is moved upward against the biasing force of the decurl pressure spring 31.

As the decurl counter roller bearing 36 is moved upward as such, without the contact of the upper surface 37*b* of the conveyance guide 37 on the upstream side in the sheet conveyance direction with the decurl counter roller 19, and the jam recovery door 35 can be closed. That is, when the jam recovery door 35 is closed, the decurl counter roller bearing 36 is moved upward by a retracting portion 105F configured by the cam follower shape 36*a* of the decurl counter roller bearing 36 and the cam shape 37*a* of the conveyance guide 37.

In addition, when the jam recovery door 35 is closed, as the decurl counter roller bearing 36 is moved, the decurl counter roller 19 is also lifted to a position where the decurl counter roller 19 does not come in contact with the jam recovery door 35. In other words, when the jam recovery door 35 is closed, as the decurl counter roller bearing 36 is moved, the decurl counter roller 19 is lifted to a position that deviates from a rotational path O (of the conveyance guide 37) of the jam recovery door 35 illustrated in FIG. 10B described above. As a result, when the jam recovery door 35 is closed, flaws on the surfaces of the conveyance guide 37 and the decurl counter roller 19 can be prevented. In addition, since the torsion coil spring 40 is provided, when the user releases the hand from the jam recovery door 35, the jam recovery door 35 is closed without the contact between the conveyance guide 37 and the decurl counter roller 19, and thus the user does not forget to close the jam recovery door 35.

In addition, even when the jam recovery door 35 is opened, similarly to when the jam recovery door 35 is closed, the decurl counter roller bearing 36 is pressed by the cam shape 37*a* of the conveyance guide 37 and is lifted upward. Accordingly, when the jam recovery door 35 is opened, flaws on the surfaces of the conveyance guide 37 and the decurl counter roller 19 can be prevented.

As described above, in this embodiment, when the jam recovery door 35 is opened and closed, the retracting portion 105F causes the decurl counter roller bearing 36 to be retracted to a position at which the decurl counter roller 19 deviates from the rotational path (movement path) of the jam recovery door 35. Accordingly, the jam recovery door 35 can be opened and closed without damaging the conveyance guide 37 and the decurl counter roller 19. In addition, when the jam recovery door 35 is opened and closed, the A state in which the fixing nip pressure is "weak" and the decurl nip pressure is "weak" is set, and thus the jam recovery door 35 can be opened with a small operating force, thereby enhancing jam recovery characteristics.

Figure 12A:
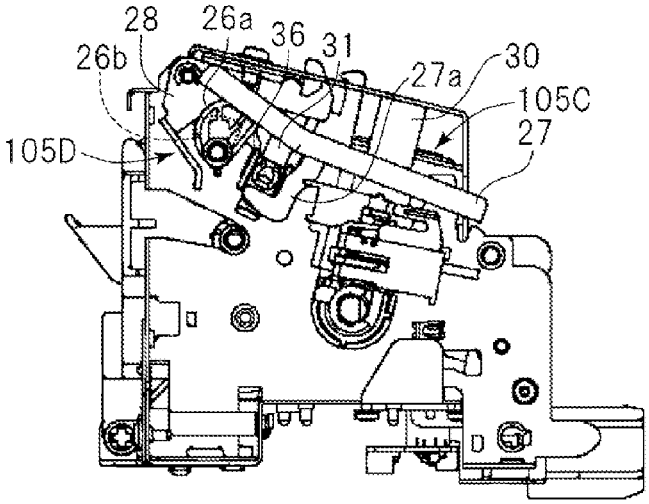
FIGS. 12A to 12C are diagrams illustrating the configuration of a fixing device provided in an image forming apparatus according to a second embodiment of the invention.
Figure 12B:
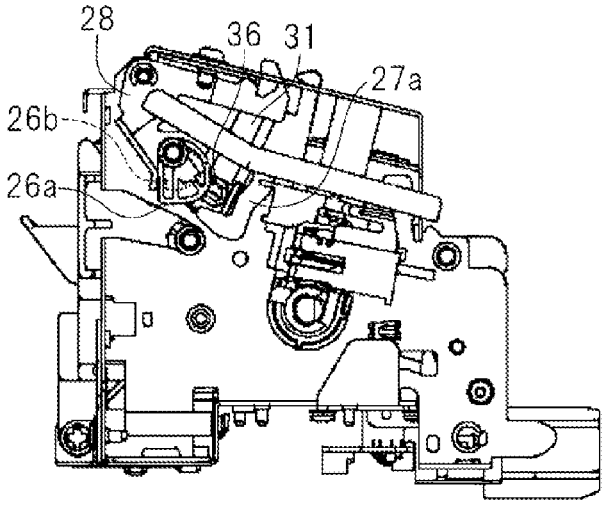
Figure 12C:
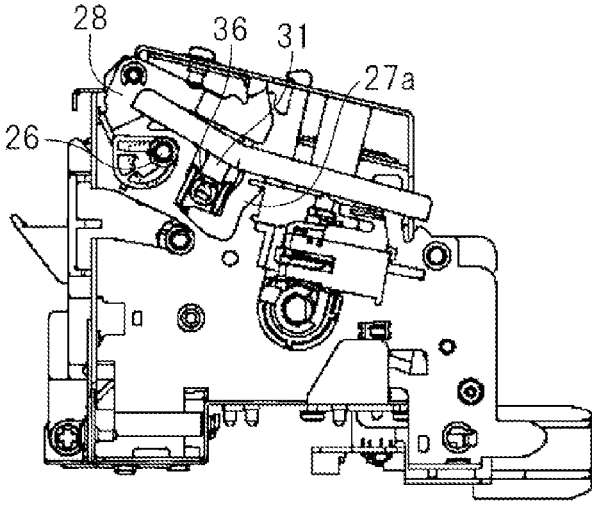

Next, a second embodiment of the invention will be described. FIGS. 12A to 12C are diagrams illustrating the configuration of a fixing device provided in an image forming apparatus according to this embodiment. In addition, in FIGS. 12A to 12C, like reference numerals as those in FIGS. 4A to 4C described above denote like or corresponding elements. In FIGS. 12A to 12C, a hook shape 27*a* is provided at the bottom surface of the fixing pressure lever 27, and the hook shape 27*a* is locked to the bearing outer peripheral portion of the decurl counter roller bearing 36.

FIG. 12A illustrates the state of the fixing device during conveyance and during a jam recovery. At this time, the fixing pressure lever 27 is turned upward against the fixing pressure spring 30 by the outside cam shape 26*a* of the pressure control cam 26 and is separated from the fixing flange 29. Therefore, the pressurizing force of the fixing pressure spring 30 is not applied to the fixing film 15, and the fixing nip pressure becomes approximately 0 under the self-weights of only the fixing flange 29 and the fixing film 15. That is, the fixing nip pressure becomes "weak".

Figure 13:
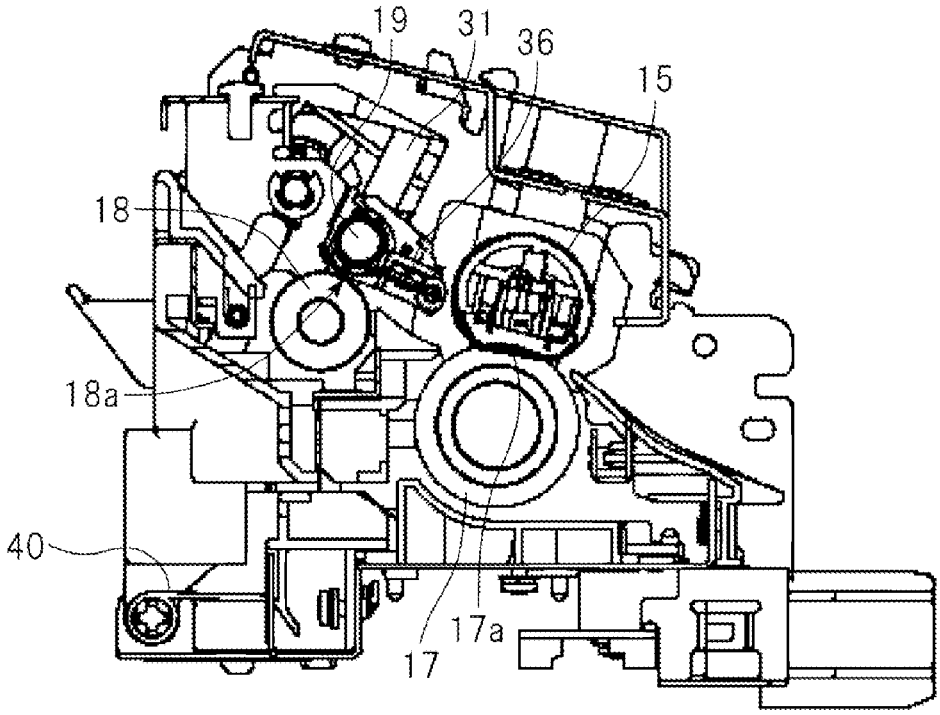
FIG. 13 is a diagram illustrating a state where a decurl counter roller provided in the fixing device is separated from a decurl roller.

On the other hand, when the fixing pressure lever 27 is turned upward, the hook shape 27*a* locked to the decurl counter roller bearing 36 is also lifted, and thus the decurl counter roller bearing 36 is moved upward. Accordingly, as illustrated in FIG. 13, the decurl counter roller 19 is separated from the decurl roller 18 and the decurl nip pressure is in a "weak" state. That is, during conveyance and the jam recovery, when the fixing nip pressure is "weak", the decurl counter roller 19 can be separated from the decurl roller 18 by the hook shape 27*a* which is a separating portion. As a result, the state in which the fixing nip pressure is "weak" and the decurl nip pressure is "weak" is set by the fixing nip pressure changing mechanism 105C and the decurl nip pressure changing mechanism 105D.

FIG. 12B illustrates the state of the fixing device when the pressure control cam 26 is rotated clockwise by 140° from the state of FIG. 12A. At this time, the outside cam shape 26*a* of the pressure control cam 26 is separated from the fixing pressure lever 27, and the fixing pressure lever 27 is turned downward by the fixing pressure spring 30. As a result, the pressurizing force of the fixing pressure spring 30 is applied to the fixing film 15 via the fixing pressure lever 27 and the fixing flange 29 and thus the fixing nip pressure is in a "strong" state.

On the other hand, when the fixing pressure lever 27 is turned downward, the hook shape 27*a* is also lowered. Accordingly, the decurl counter roller bearing 36 is lowered, and the decurl roller 18 and the decurl counter roller 19 come in contact with each other. In addition, since the inside cam shape 26*b* of the pressure control cam 26 and the decurl pressure lever 28 are separated from each other at this time, the decurl nip pressure remains in the "weak" state. That is, in the state where temperature or humidity is low and the amount of moisture in the air is low, the state in which the fixing nip pressure is "strong" and the decurl nip pressure is "weak" is set by the fixing nip pressure changing mechanism 105C and decurl nip pressure changing mechanism 105D.

FIG. 12C illustrates a state where the pressure control cam 26 is rotated clockwise by 80° from the state of FIG. 12B. At this time, the outside cam shape 26*a* of the pressure control cam 26 is separated from the fixing pressure lever 27 and the pressurizing force of the fixing pressure spring 30 is applied to the fixing film 15 via the fixing pressure lever 27 and the fixing flange 29 such that the fixing nip pressure remains in the "strong" state. On the other hand, when the pressure control cam 26 is rotated clockwise by 80°, the inside cam shape 26*b* of the pressure control cam 26 comes in contact with the decurl pressure lever 28 to rotate the decurl pressure lever 28 clockwise. In addition, since the hook shape 27*a* is separated from the decurl counter roller bearing 36 at this time, when the decurl pressure lever 28 is rotated clockwise, the spring length of the decurl pressure spring 31 is shortened and thus the decurl nip pressure is in a "strong" state. That is, in the state where temperature and humidity are high and the amount of moisture in the air is high, the state in which the fixing nip pressure is "strong" and the decurl nip pressure is "strong" is set by the fixing nip pressure changing mechanism 105C and the decurl nip pressure changing mechanism 105D.

Figure 14A:
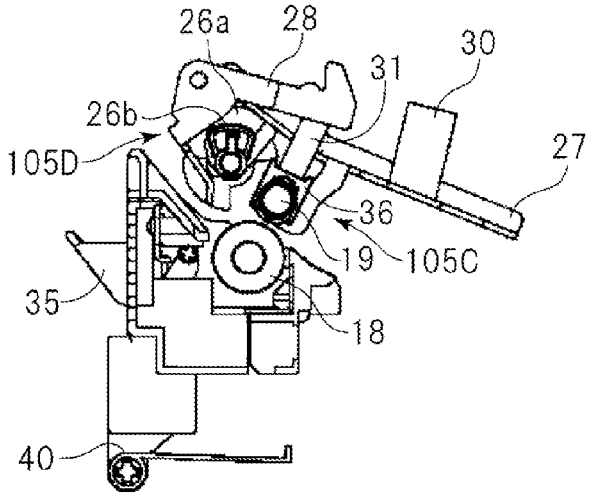
FIGS. 14A to 14C are diagrams illustrating states of the jam recovery door, the fixing nip pressure changing mechanism, and the decurl nip pressure changing mechanism when the jam recovery door is opened.
Figure 14B:
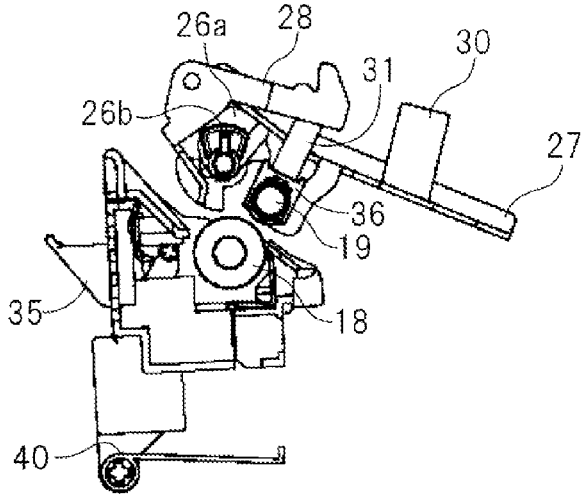
Figure 14C:
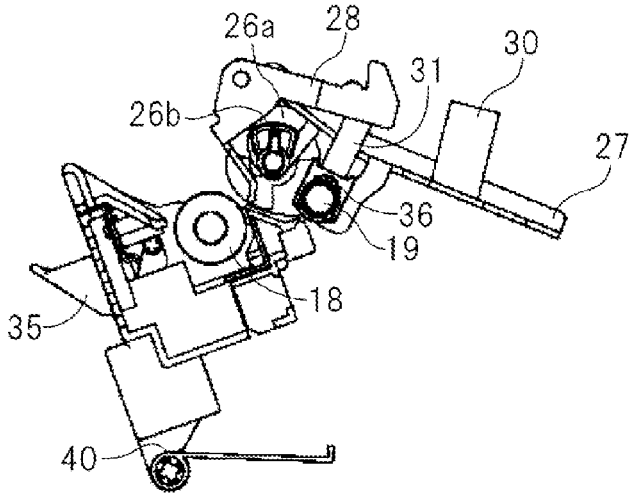

FIG. 14A illustrates the states of the jam recovery door 35, the fixing nip pressure changing mechanism 105C, and the decurl nip pressure changing mechanism 105D when the jam recovery door 35 is closed during the jam recovery illustrated in FIG. 12A. FIG. 14B illustrates a case where the jam recovery door 35 is opened by 3 degrees during the jam recovery, and FIG. 14C illustrates the states of the jam recovery door 35, the fixing nip pressure changing mechanism 105C, and the decurl nip pressure changing mechanism 105D in a case where the jam recovery door 35 is opened by 20 degrees.

Here, when the jam recovery door 35 is opened, in addition to that the fixing nip pressure is approximately 0 as described above, the decurl counter roller 19 is lifted by the hook shape 27*a*. Therefore, the decurl roller 18 and the decurl counter roller 19 are separated from each other. As a result, an operating force required to open and close the jam recovery door 35 is further reduced.

In addition, in a case of a blackout, or in a case where the user turns off the power by mistake while the print job is performed, there is a possibility that the jam recovery door 35 may be opened and closed in the state where the decurl roller 18 and the decurl counter roller 19 form a nip as illustrated in FIGS. 12B and 12C. Even in this case, as illustrated in FIGS. 10A, 10B, 11A, and 11B described above, flaws on the surfaces of the conveyance guide 37 and the decurl counter roller 19 can be prevented by the cam shape 37*a* provided in the conveyance guide 37 and the cam follower shape 36*a* provided in the decurl counter roller bearing 36.

Here, as illustrated in FIG. 13 described above, a separation conveyance guide 38 which is a guide member that guides the sheet passing through the fixing nip 17*a* to the decurl nip 18*a* is provided between the fixing nip 17*a* and the decurl nip 18*a*. Here, the upstream side of the separation conveyance guide 38 has a function of guiding the tip end of the sheet and preventing winding thereof in a case where the sheet is conveyed to the fixing film 15 in such a direction that the sheet is wound. Therefore, the upstream end of the separation conveyance guide 38 can be disposed as close as possible to the fixing film 15 without coming in contact with the fixing film 15. In addition, the downstream side of the separation conveyance guide 38 has a function of allowing the tip end of the sheet to infiltrate into the decurl nip 18*a*. Therefore, the downstream end of the separation conveyance guide 38 can be provided to be at the same position particularly in the height direction as the decurl nip 18*a* while approaching the decurl nip 18*a*.

Figure 15:
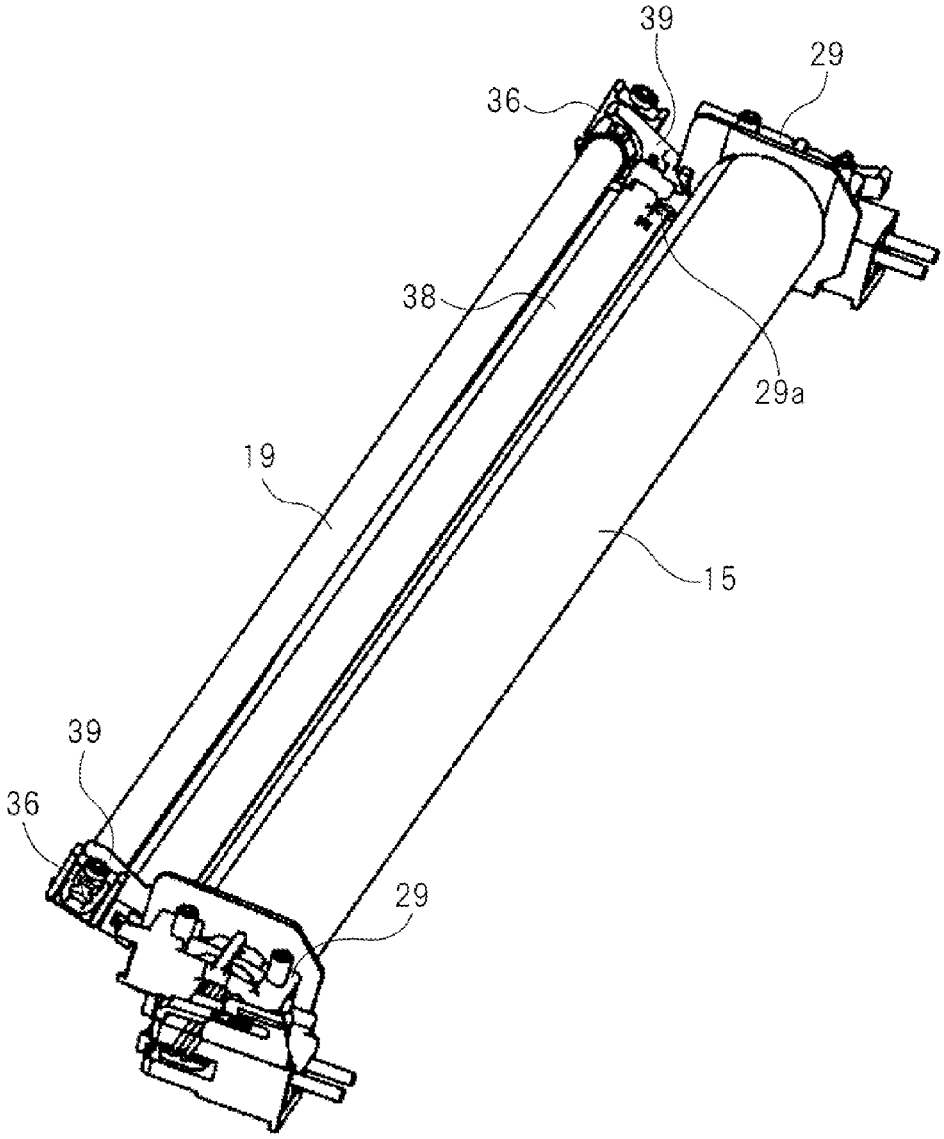
FIG. 15 is a diagram illustrating a separation conveyance guide holder provided in the fixing device.

FIG. 15 is a perspective view illustrating the separation conveyance guide 38 viewed from above, in which the upstream side end (fixing nip side end) of the separation conveyance guide 38 in the sheet conveyance direction is fixed to a separation conveyance guide holder 39. The separation conveyance guide holder 39 is supported by the fixing flange 29 to freely turn by fitting a boss 29*a* provided in the fixing flange 29 to a fitting hole (not illustrated) provided on the upstream side. That is, the upstream side end of the separation conveyance guide holder 39 in the sheet conveyance direction is supported by the fixing flange 29 to be able to turn via the separation conveyance guide holder 39.

In the separation conveyance guide holder 39, a U-shaped groove (not illustrated) provided in the downstream side end (correction nip side end) in the sheet conveyance direction is fitted to the decurl counter roller bearing 36. Accordingly, when the decurl counter roller bearing 36 is moved, the separation conveyance guide 38 is turned (moved) integrally with the decurl counter roller bearing 36, in other words, the decurl counter roller 19.

Figure 16A:
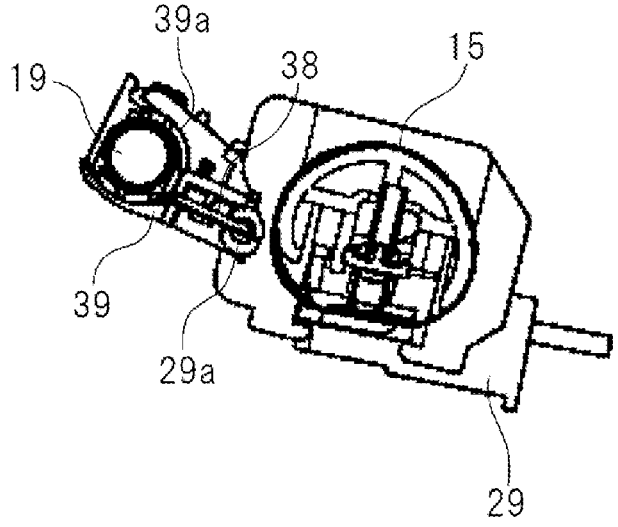
FIGS. 16A and 16B are diagrams illustrating an operation of a separation conveyance guide.
Figure 16B:
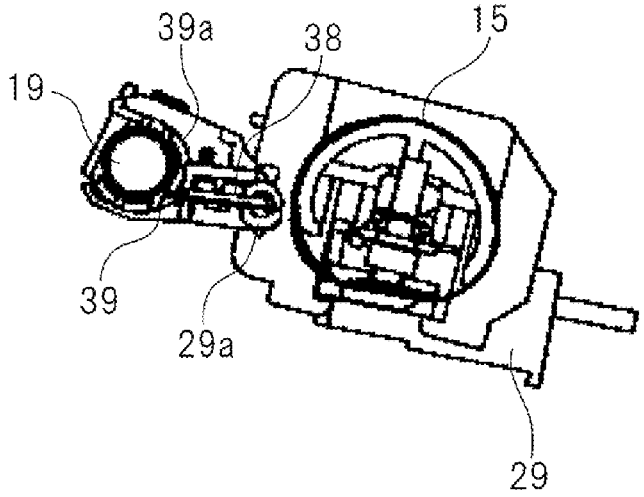

FIG. 16A is a diagram illustrating a case where the decurl counter roller 19 is moved upward and the decurl nip is separated, that is, the state illustrated in FIG. 12A, and FIG. 16B is a diagram illustrating the state of the separation conveyance guide 38 in other cases. In addition, by supporting the separation conveyance guide holder 39 by the fixing flange 29 to freely turn, even in a case where the decurl nip is separated, distance accuracy between the upstream end of the separation conveyance guide and the fixing film 15 can be increased. Further, the separation conveyance guide holder 39 can be moved integrally with the decurl counter roller 19, and thus height position accuracy between the downstream end of the separation conveyance guide and the decurl nip can be increased. Accordingly, a jam which occurs when the sheet is wound around the fixing film 15 or when the tip end of the sheet does not enter the decurl nip can be prevented.

Here, in the above description, a threshold of the amount of moisture for switching the states of the fixing nip pressure changing mechanism 105C and decurl nip pressure changing mechanism 105D is set to 19.1 g/m$^2$. However, in a case where the threshold of the amount of moisture is constant, when the amount of moisture in the air is close to 19.1 g/m$^2$, the decurl nip pressure is frequently switched for every print job. In addition, when the decurl nip pressure is frequently switched as such, there may be cases where the amount of curl is changed and paper discharging and loading characteristics are degraded. Therefore, in order to prevent the degradation of the paper discharging and loading characteristics, the threshold of the amount of moisture may be changed.

Next, an image forming apparatus according to a third embodiment of the invention in which the threshold of the amount of moisture is changed as described above will be described. In this embodiment, the threshold for switching the states of the fixing nip pressure changing mechanism 105C and the decurl nip pressure changing mechanism 105D is changed by a current decurl nip pressure.

Figure 17:
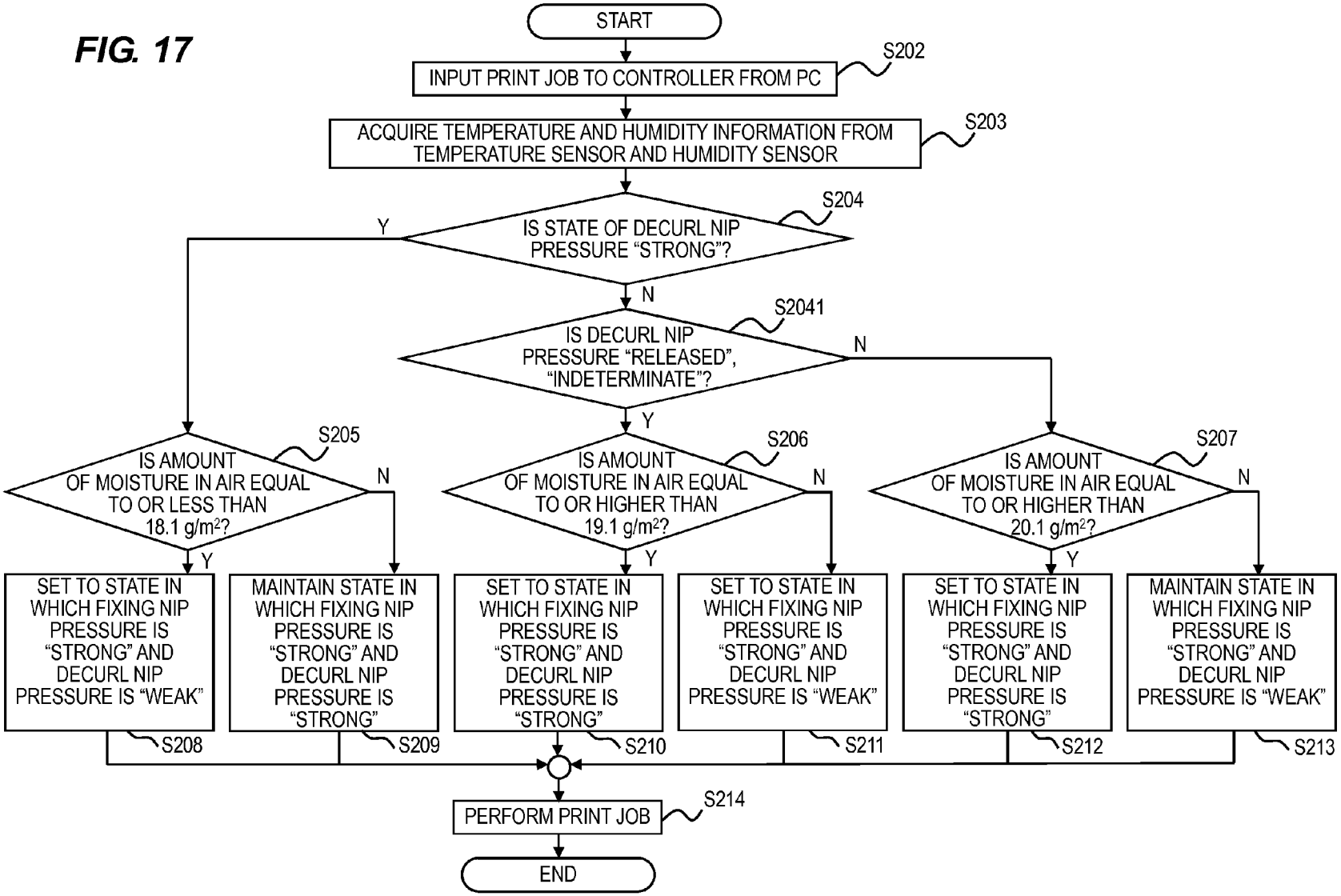
FIG. 17 is a flowchart illustrating a control process of changing a threshold for switching the states of the fixing nip pressure changing mechanism and the decurl nip pressure changing mechanism of an image forming apparatus according to a third embodiment of the invention, by using a current decurl nip pressure.

FIG. 17 is a flowchart illustrating a control process according to this embodiment, in which the threshold for switching the states of the fixing nip pressure changing mechanism 105C and the decurl nip pressure changing mechanism 105D is changed according to a current decurl nip pressure. Here, in this embodiment, when the current decurl nip pressure is "strong", the threshold is set to 18.1 g/m$^2$, the threshold when the decurl nip pressure is "released" or "indeterminate" is set to 19.1 g/m$^2$, and the threshold when the decurl nip pressure is "weak" is set to 20.1 g/m$^2$. In addition, the state where the decurl nip pressure is "indeterminate" is an initial state when the power of the printer body 101 is "ON" from "OFF".

When a print job is input to the controller from the external PC (S202), the control portion 150 acquires temperature information and humidity information from the temperature sensor 12*a* and the humidity sensor 12*b* (S203). In addition, the control portion 150 obtains the amount of moisture in the air from the acquired temperature information and humidity information and determines a current decurl nip pressure using the information from the state detection sensor 34.

In addition, when the current decurl nip pressure is "strong" (Y in S204), the control portion 150 determines whether or not the amount of moisture in the air is equal to or less than 18.1 g/m$^2$ (smaller than 19.1 g/m$^2$) (S205). When it is determined that the amount of moisture in the air is equal to or less than 18.1 g/m$^2$ (Y in S205), the control portion 150 determines that the curl is small and sets the fixing nip pressure and decurl nip pressure to "strong" and "weak", respectively (S208). When it is determined that the amount of moisture in the air is not equal to or less than 18.1 g/m$^2$ (N in S205), the control portion 150 determines that the curl is large and holds the decurl nip pressure "strong" (S209). That is, when the amount of moisture in the air is not equal to or less than 18.1 g/m$^2$, the decurl nip pressure is not switched to the "weak" state.

In a case where the current decurl nip pressure is not "strong" (N in S204), the control portion 150 determines whether or not the decurl nip pressure is "released" or "indeterminate" (S2041). In addition, when it is determined that the decurl nip pressure is "released" or "indeterminate" (Y in S2041), the control portion 150 determines whether or not the amount of moisture in the air is equal to or higher than 19.1 g/m$^2$ (S206). Here, in a case where it is determined that the amount of moisture in the air is equal to or higher than 19.1 g/m$^2$ (Y in S206), the control portion 150 sets the fixing nip pressure to "strong", determines that the curl is large, and sets the decurl nip pressure to "strong" (S210). When it is determined that the amount of moisture in the air is equal to or less than 19.1 g/m$^2$ (N in S206), the control portion 150 sets the fixing nip pressure to "strong", determines that the curl is small, and sets the decurl nip pressure to "weak" (S211). That is, in the case where the decurl nip pressure is "released" or "indeterminate", when the amount of moisture in the air is not equal to or higher than 19.1 g/m$^2$, the decurl nip pressure is not switched to the "strong" state.

When it is determined that the decurl nip pressure is not "released" or "indeterminate" (N in S2041), that is, when it is determined that the decurl nip pressure is "weak", the control portion 150 determines whether or not the amount of moisture in the air is equal to or higher than 20.1 g/m$^2$ (greater than 19.1 g/m$^2$) (S207). In addition, when it is determined that the amount of moisture in the air is equal to or higher than 20.1 g/m$^2$ (Y in S207), the control portion 150 sets the fixing nip pressure to "strong", determines that the curl is large, and sets the decurl nip pressure to "strong" (S212). When it is determined that the amount of moisture in the air is not equal to or higher than 20.1 g/m$^2$ (N in S207), the control portion 150 sets the fixing nip pressure to "strong", determines that the curl is small, and holds the decurl nip pressure "weak" (S213).

That is, in a case where a curl nip pressure is "weak", when the amount of moisture in the air is not equal to or higher than 20.1 g/m$^2$, the decurl nip pressure is not switched to the "strong" state. In addition, after setting the decurl nip pressure and the curl nip pressure by selecting the amount of moisture in the air based on the decurl nip pressure as such, the control portion 150 starts the conveyance of the sheet and the image forming operation and performs the print job (S214).

As described above, in this embodiment, the amount of moisture in the air (threshold) is selected based on the decurl nip pressure to set the decurl nip pressure and the curl nip pressure. Accordingly, when the amount of moisture in the air is close to 19.1 g/m$^2$, the degradation of the paper discharging and loading characteristics which occurs because the decurl nip pressure is frequently switched for every print job and thus the amount of curl is changed can be prevented.

In this embodiment, the case where the threshold is changed based on the decurl nip pressure is described. However, the threshold may also be changed using not only the decurl nip pressure but also information regarding the fixing nip pressure. That is, the threshold for switching the fixing nip pressure and the decurl nip pressure may be changed based on a current fixing nip pressure and the decurl nip pressure.

Figure 18:
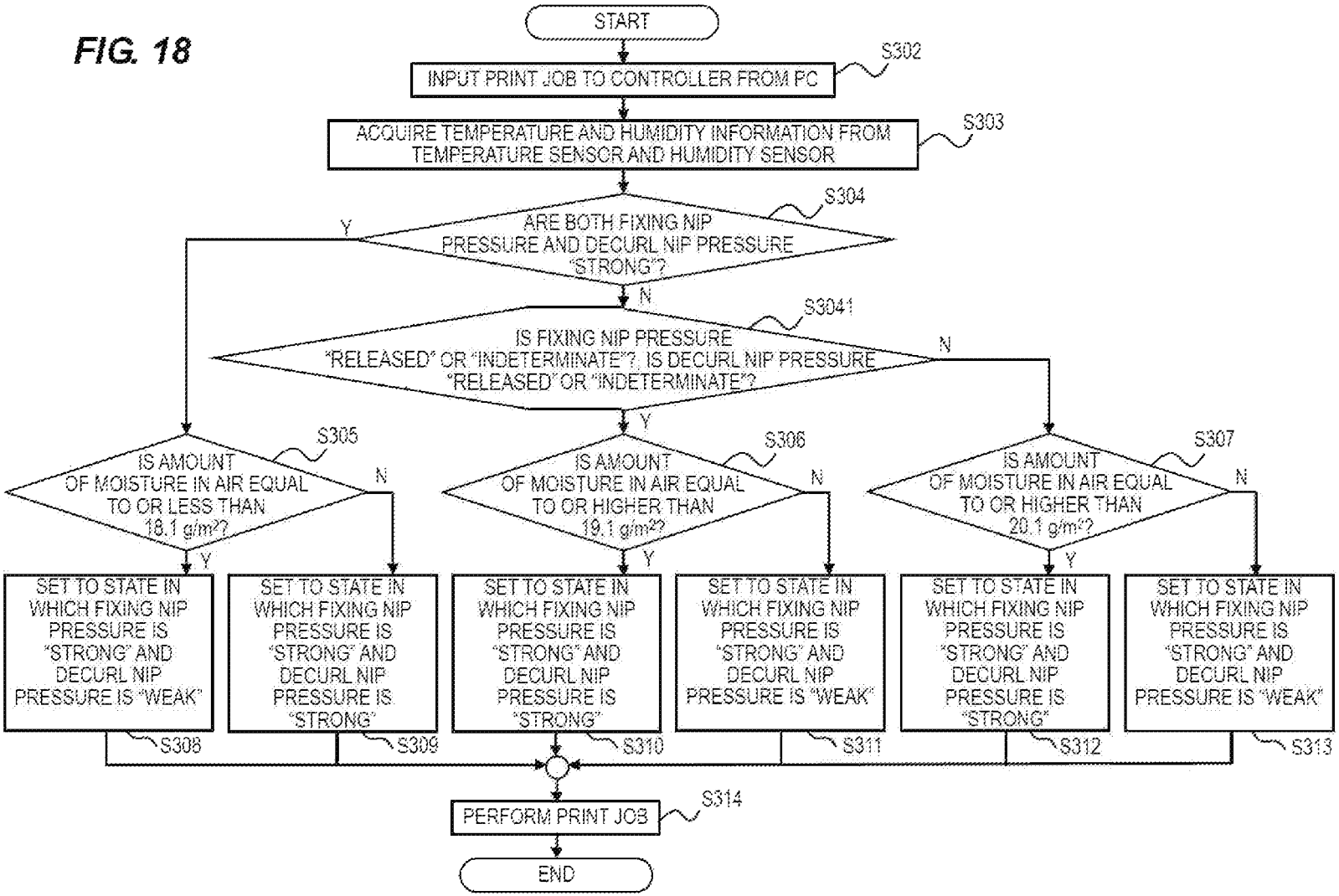
FIG. 18 is a flowchart illustrating another control process of this embodiment, in which the threshold for switching the states of the fixing nip pressure changing mechanism and the decurl nip pressure changing mechanism is changed by using the current decurl nip pressure and the fixing nip pressure.

FIG. 18 is a flowchart illustrating another control process according to this embodiment, in which the threshold for switching the fixing nip pressure and the decurl nip pressure as described above is changed by a current fixing nip pressure and the decurl nip pressure. In another control process according to this embodiment, when the current fixing nip pressure and the decurl nip pressure are "strong", the threshold is set to 18.1 g/m$^2$. In addition, the threshold when the decurl nip pressure is "released" or "indeterminate" is set to 19.1 g/m$^2$, and the threshold when the decurl nip pressure is "weak" is set to 20.1 g/m$^2$. The state where the fixing nip pressure and the decurl nip pressure are "indeterminate" is an initial state when the power of the printer body 101 is "ON" from "OFF".

When a print job is input to the controller from the external PC (S302), the control portion 150 acquires temperature information and humidity information from the temperature sensor 12*a* and the humidity sensor 12*b* (S303). In addition, the control portion 150 obtains the amount of moisture in the air from the acquired temperature information and humidity information and a table (not illustrated) and determines the current fixing nip pressure and the decurl nip pressure using the information from the state detection sensor 34.

In addition, when the current fixing nip pressure is "strong" and the decurl nip pressure is "strong" (Y in S304), the control portion 150 determines whether or not the amount of moisture in the air is equal to or less than 18.1 g/m$^2$ (smaller than 19.1 g/m$^2$) (S305). When it is determined that the amount of moisture in the air is equal to or less than 18.1 g/m$^2$ (Y in S305), the control portion 150 sets the fixing nip pressure and decurl nip pressure to "strong" and "weak", respectively (S308). When it is determined that the amount of moisture in the air is not equal to or less than 18.1 g/m$^2$ (N in S305), the control portion 150 sets the fixing nip pressure and decurl nip pressure to "strong" and "strong", respectively (S309). That is, when the amount of moisture in the air is not equal to or less than 18.1 g/m$^2$, while the fixing nip pressure is "strong", the decurl nip pressure is not switched to the "weak" state.

In a case where the decurl nip pressure is not "strong" (N in S304) while the current fixing nip pressure is "strong", the control portion 150 determines whether or not the fixing nip pressure and the decurl nip pressure are "released" or "indeterminate" (S3041). In addition, when it is determined that the fixing nip pressure and the decurl nip pressure are "released" or "indeterminate" (Y in S3041), the control portion 150 determines whether or not the amount of moisture in the air is equal to or higher than 19.1 g/m$^2$ (S306). In addition, when it is determined that the amount of moisture in the air is equal to or higher than 19.1 g/m$^2$ (Y in S306), the control portion 150 sets the fixing nip pressure and the decurl nip pressure to "strong" and "strong", respectively (S310). When it is determined that the amount of moisture in the air is equal to or less than 19.1 g/m$^2$ (N in S306), the control portion 150 sets the fixing nip pressure and the decurl nip pressure to "strong" and "weak", respectively (S311).

When it is determined that the fixing nip pressure and the decurl nip pressure are not "released" or "indeterminate" (N in S3041), the control portion 150 determines whether or not the amount of moisture in the air is equal to or higher than 20.1 g/m$^2$ (greater than 19.1 g/m$^2$) (S307). In addition, when it is determined that the amount of moisture in the air is equal to or higher than 20.1 g/m$^2$ (Y in S307), the control portion 150 sets the fixing nip pressure and the decurl nip pressure to "strong" and "strong", respectively (S312). When it is determined that the amount of moisture in the air is not equal to or higher than 20.1 g/m$^2$ (N in S307), the control portion 150 sets the fixing nip pressure and the decurl nip pressure to "strong" and "weak", respectively (S313). After setting the decurl nip pressure and the curl nip pressure by selecting the amount of moisture in the air based on the fixing nip pressure and the decurl nip pressure as such, the control portion 150 starts the conveyance of the sheet and the image forming operation and performs the print job (S314).

By performing the control process as described above, when the amount of moisture in the air is close to 19.1 g/m$^2$, the degradation of the paper discharging and loading characteristics which occurs because the decurl nip pressure is frequently switched for every print job and thus the amount of curl is changed can be prevented.

Figure 19:
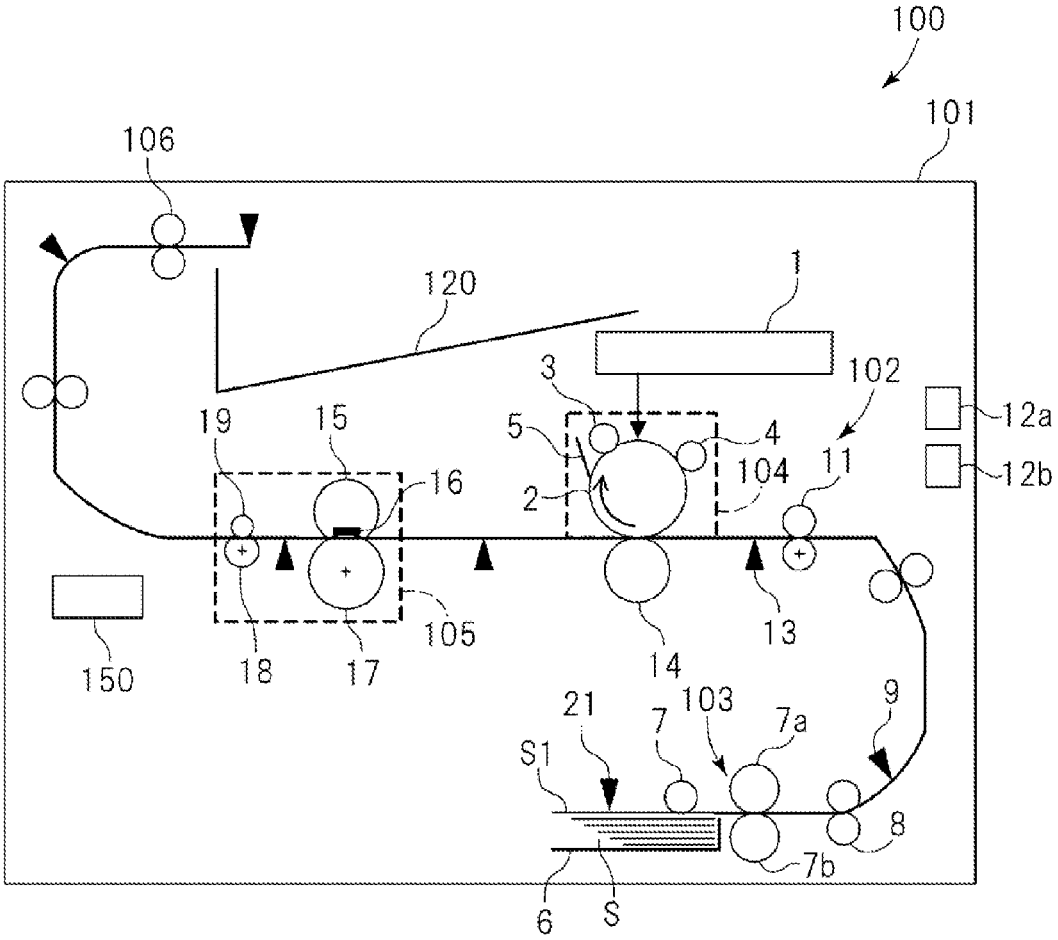
FIG. 19 is a diagram illustrating the entire configuration of a laser beam printer which is an example of an image forming apparatus according to a fourth embodiment of the invention.

Next, a fourth embodiment of the invention will be described. FIG. 19 is a diagram illustrating the entire configuration of a laser beam printer which is an example of an image forming apparatus according to this embodiment. In FIG. 19, like reference numerals as those of FIG. 1 described above denote like or corresponding elements. In FIG. 19, a medium sensor 21 is an optical sensor which is disposed on the upper side of the sheet feeding cassette 6 and detects the basis weight and the surface property of the sheet S. In addition, in this embodiment, the control portion 150 controls conduction of the fixing heater 16 based on information regarding the basis weight and the surface property of the sheet S from the medium sensor 21 which is a detecting portion. In addition, after setting appropriate fixing temperature adjustment depending on the basis weight and the surface property of the sheet S as such, the fixing nip pressure and the decurl nip pressure are also set according to the amount of moisture in the air.

Here, in a case of a thick sheet, the sheet is not easily fixed. Therefore, the fixing temperature adjustment is set to be high. However, since the thick sheet has high rigidity and has a small amount of curl caused by the fixing nip, the decurl nip pressure needs to be set to weak. In addition, in a case of a thin sheet having a good surface property, the sheet is easily fixed. Therefore, the fixing temperature adjustment is set to be low. However, the thin sheet has low rigidity and has a high amount of curl caused by the fixing nip, the decurl nip pressure needs to be set to "strong". In a case of a thin sheet having a poor surface property, the sheet is not easily fixed, and thus the fixing temperature adjustment is set to be high. Furthermore, in the case of the thin sheet having a poor surface property, in addition to that the rigidity thereof is low and the amount of curl caused by the fixing nip is high, the fixing temperature adjustment is set to be high. Therefore, the amount of curl is further increased.

Figure 20:
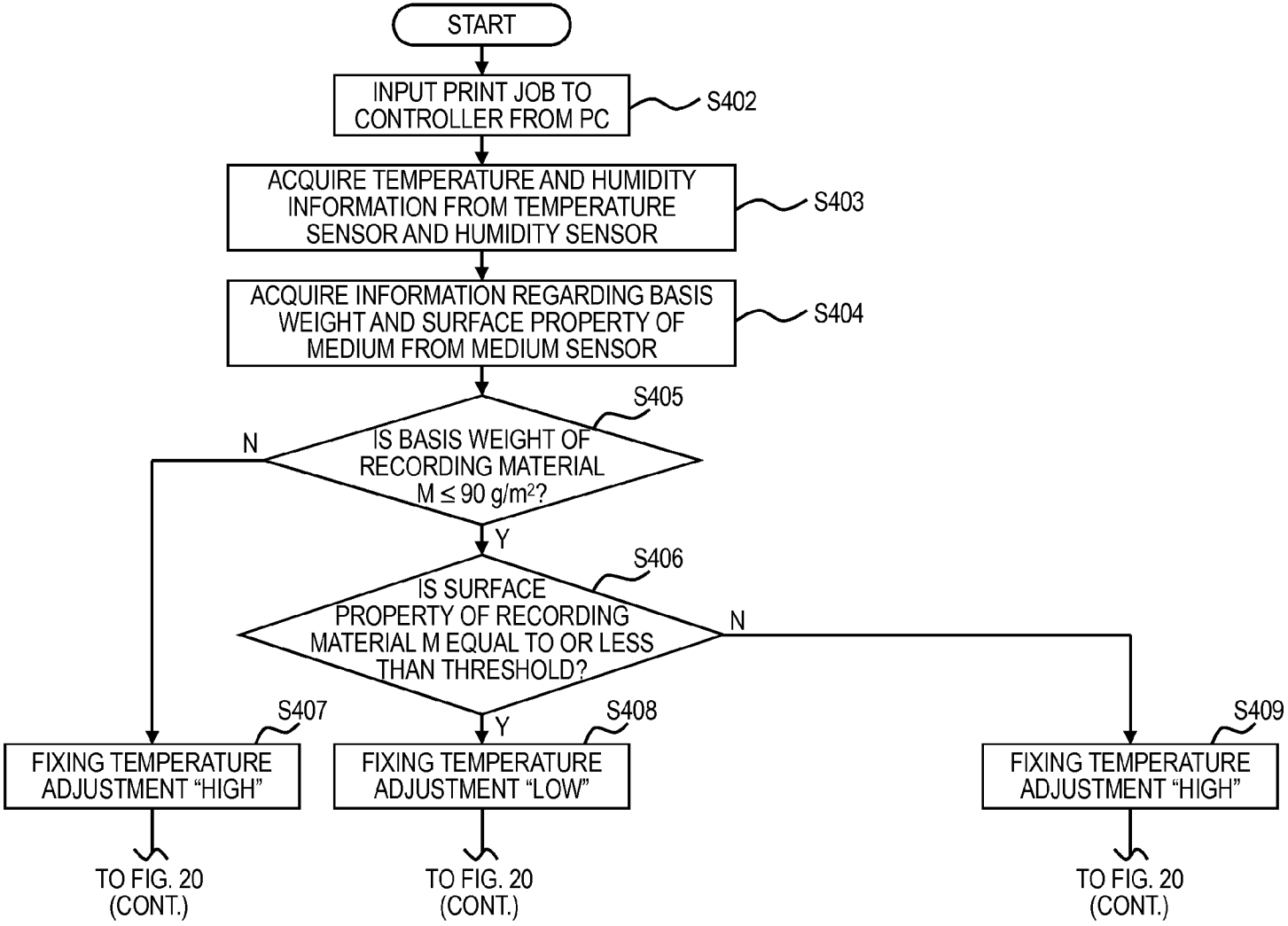
FIG. 20 is a flowchart illustrating a control process of setting a curl nip pressure according to the basis weight and the surface property of a sheet according to this embodiment.
Figure 20:
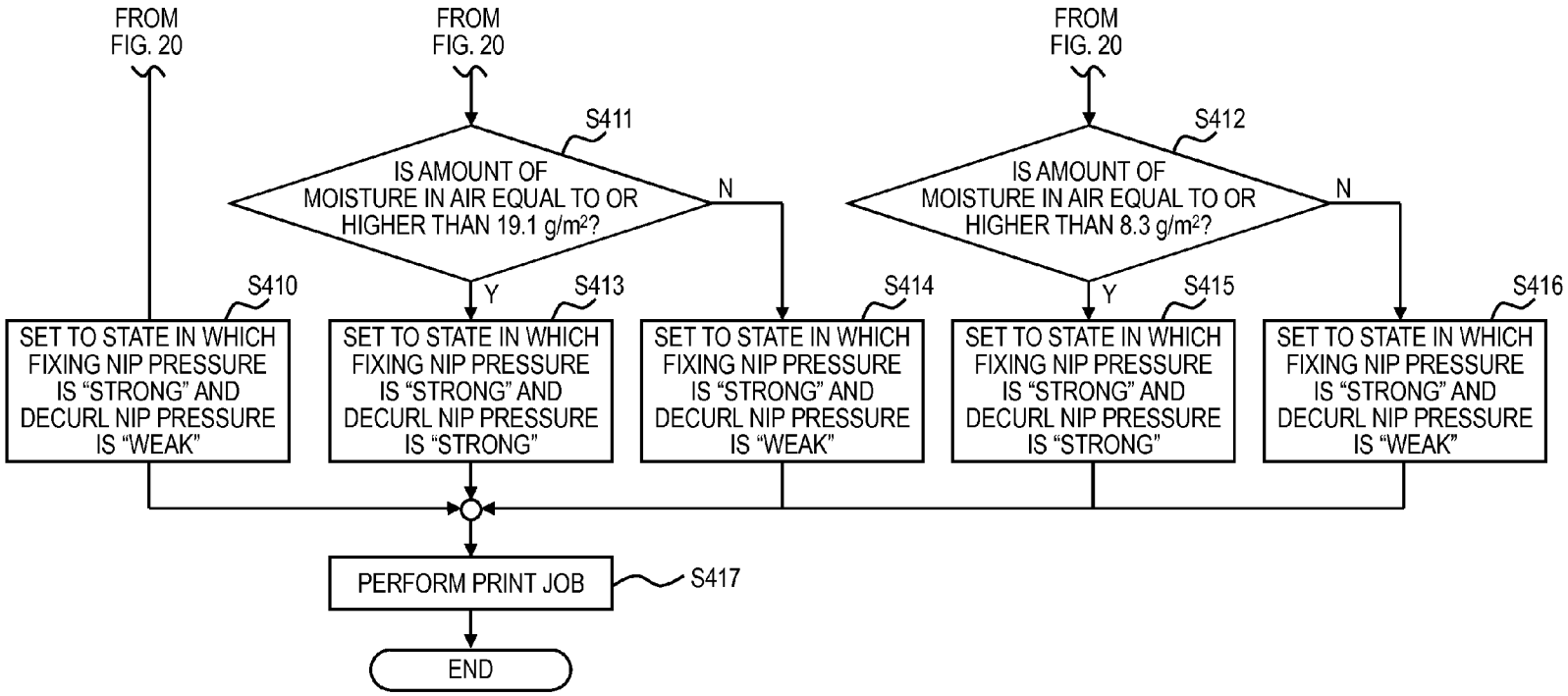

Here, a control process of setting the curl nip pressure according to the basis weight and the surface property of the sheet S according to this embodiment will be described by using a flowchart illustrated in FIG. 20. When a print job is input to the controller from the external PC (S402), the control portion 150 acquires temperature information and humidity information from the temperature sensor 12*a* and the humidity sensor 12*b* (S403). In addition, the control portion 150 obtains the amount of moisture in the air from the acquired temperature information and humidity information and a table (not illustrated) and determines a current decurl nip pressure.

Next, the control portion 150 acquires information regarding the basis weight and the surface property of the sheet from the medium sensor 21 (S404) and determines whether or not the basis weight of the sheet is 90 g/m$^2$ (S405). In addition, in a case of a sheet of which the basis weight is not 90 g/m$^2$, that is, in a case of a thick sheet, the sheet is not easily fixed. Therefore, the control portion 150 sets the fixing temperature adjustment to "high" (S407). In addition, since the thick sheet has high rigidity and has a low amount of curl caused by the fixing nip, the control portion 150 sets the fixing nip pressure and the decurl nip pressure to "strong" and "weak", respectively (S410).

In addition, it is determined whether or not the basis weight of the sheet is ≤90 g/m$^2$ and the surface property of the sheet is equal to or less than a predetermined threshold (S406). In addition, in a case where the basis weight of the sheet is ≤90 g/m$^2$ and the surface property thereof is equal to or less than the predetermined threshold (Y in S406), that is, in a case of a thin sheet having a good surface property, the sheet is easily fixed. Therefore, the control portion 150 sets the fixing temperature adjustment to "low" (S408). In addition, the thin sheet has low rigidity and has a large amount of curl caused by the fixing nip. Therefore, the control portion 150 subsequently determines whether or not the amount of moisture in the air is equal to or higher than 19.1 g/m$^2$ (S411).

In addition, in a case where the amount of moisture in the air is equal to or higher than 19.1 g/m$^2$ (Y in S411), that is, in a case of a high temperature and a high humidity, the control portion 150 sets the fixing nip pressure and the decurl nip pressure to "strong" and "strong", respectively (S413). In a case where the amount of moisture in the air is not equal to or higher than 19.1 g/m$^2$ (N in S411), that is, in a room temperature and normal humidity environment or a low temperature and low humidity environment, the control portion 150 sets the fixing nip pressure and the decurl nip pressure to "strong" and "weak", respectively (S414).

In addition, in a case where the basis weight of the sheet is ≤90 g/m$^2$ and the surface property of the sheet is not equal to or less than the threshold (N in S406), that is, in a case of a thin sheet having a poor surface property, the sheet is not easily fixed. Therefore, the control portion 150 sets the fixing temperature adjustment to "high" (S409). Here, in addition to that the thin sheet has low rigidity and a large amount of curl caused by the fixing nip, the fixing temperature adjustment is set to be high. Therefore, the amount of curl is further increased.

Accordingly, in this embodiment, "an amount of moisture in the air of 8.3 g/m$^2$" corresponding to a temperature of 23° C. and a humidity of 40% other than "an amount of moisture in the air of 19.1 g/m$^2$" corresponding to a temperature of 27° C. and a humidity of 70% is the threshold for switching between "strong" and "weak" of the decurl nip pressure. Therefore, the control portion 150 determines whether or not the amount of moisture in the air is equal to or higher than 8.3 g/m$^2$ (S412), and in a case where the amount of moisture in the air is equal to or higher than 8.3 g/m$^2$ (Y in S412), the fixing nip pressure is set to "strong" and the decurl nip pressure is set to "strong" (S415).

In addition, in a case where the amount of moisture in the air is not equal to or higher than 8.3 g/m$^2$ (N in S412), that is, in the low temperature and low humidity environment, the control portion 150 sets the fixing nip pressure and the decurl nip pressure to "strong" and "weak", respectively (S416). In addition, after setting the decurl nip pressure and the curl nip pressure according to the basis weight and the surface property of the sheet S as such, the control portion 150 starts the conveyance of the sheet and the image forming operation and performs the print job (S417).

As described above, in this embodiment, the decurl nip pressure and the curl nip pressure are set according to the basis weight and the surface property of the sheet. Accordingly, fixing temperature adjustment and the decurl nip pressure by which both good fixability and a low degree of curling can be achieved can be automatically set according to the basis weight and the surface property of the sheet.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-243667, filed Nov. 5, 2012, which is hereby incorporated by reference herein in its entirety.

What is claimed is:

1. An image forming apparatus comprising:

an image forming portion which forms a toner image;

a transfer portion which transfers the toner image onto a sheet;

a fixing portion which includes a pressure roller and a heating member that forms a fixing nip to fix the toner image onto the sheet by coming in press contact with the pressure roller;

a curl correcting unit which is provided on a downstream of the fixing portion in a sheet conveyance direction and includes a first roller and a second roller that forms a correction nip to correct a curl of the sheet by coming in press contact with the first roller;

a holding portion which movably holds the second roller;

a biasing member which applies a force to the holding portion in such a direction that the second roller comes in press contact with the first roller;

a door which rotatably holds the first roller, is supported to be opened and closed, and separates the first roller from the second roller by being opened; and a retracting portion which causes the holding portion to be retracted to a position where the second roller deviates from a movement path of the door against a biasing force of the biasing member according to a closing operation of the door.

2. The image forming apparatus according to claim 1, wherein the retracting portion includes a cam follower provided in the holding portion and a cam provided in the door, and when the door is opened and closed, the cam and the cam follower abut on each other such that the holding portion is retracted to the position where the second roller deviates from the movement path of the door against the biasing force of the biasing member.

3. The image forming apparatus according to claim 1, further comprising:

a door biasing member which applies a force to the door in such a direction that the door is closed.

4. The image forming apparatus according to claim 1, further comprising:

a fixing pressure lever which presses the heating member and is moved to change a fixing nip pressure of the fixing nip;

a correction pressure lever which presses the second roller and is moved to change a correction nip pressure of the correction nip;

a cam member which moves each of the fixing pressure lever and the correction pressure lever; and a control portion which rotates the cam member, wherein the control portion changes the fixing nip pressure and the correction nip pressure by rotating the cam member.

5. The image forming apparatus according to claim 4, wherein the control portion switches between a first state, a second state in which the fixing nip pressure is higher than that of the first state and the correction nip pressure is the same as that of the first state, and a third state in which the fixing nip pressure is the same as that of the second state and the correction nip pressure is higher than that of the first state, by rotating the cam member.

6. The image forming apparatus according to claim 4, wherein, in a case where the door is opened and closed, the control portion allows the correction nip pressure to be low by rotating the cam member.

7. The image forming apparatus according to claim 4, wherein a separating portion which separates the second roller from the first roller is provided in the fixing pressure lever.

8. The image forming apparatus according to claim 4, further comprising:

a temperature sensor which detects an environmental temperature; and a humidity sensor which detects an environmental humidity, wherein the control portion switches states of the fixing nip pressure and the correction nip pressure by rotating the cam member based on the temperature detected by the temperature sensor and the humidity detected by the humidity sensor.

9. The image forming apparatus according to claim 8, wherein the control portion switches the states of the fixing nip pressure and the correction nip pressure by rotating the cam member based on a threshold, and the threshold is changed according to at least the correction nip pressure of which the state is not switched yet.

10. The image forming apparatus according to claim 8, further comprising:

a detecting portion which detects a basis weight and a surface property of the sheet, wherein the threshold is changed according to the basis weight and the surface property of the sheet detected by the detecting portion.

11. The image forming apparatus according to claim 1, further comprising:

a guide member which guides the sheet that passes through the fixing nip to the correction nip, wherein a fixing nip side end of the guide member is supported to be able to turn, and the holding portion is supported by a correction nip side end of the guide member.

12. The image forming apparatus according to claim 1, wherein the first roller is an elastic roller, the second roller is a non-elastic roller, and the second roller is driven to be rotated by rotating the first roller to drive.

* * * * *